US008497748B2

(12) United States Patent
Kubo et al.

(10) Patent No.: US 8,497,748 B2
(45) Date of Patent: Jul. 30, 2013

(54) BANDPASS FILTER, WIRELESS COMMUNICATION MODULE AND WIRELESS COMMUNICATION DEVICE

(75) Inventors: Takanori Kubo, Kirishima (JP); Hiromichi Yoshikawa, Kirishima (JP)

(73) Assignee: Kyocera Corporation, Kyoto (JP)

( * ) Notice: Subject to any disclaimer, the term of this patent is extended or adjusted under 35 U.S.C. 154(b) by 856 days.

(21) Appl. No.: 12/580,944

(22) Filed: Oct. 16, 2009

(65) Prior Publication Data

US 2010/0033270 A1 Feb. 11, 2010

Related U.S. Application Data

(63) Continuation-in-part of application No. PCT/JP2008/055139, filed on Mar. 19, 2008.

(30) Foreign Application Priority Data

Apr. 17, 2007 (JP) ..... 2007-108036
Sep. 27, 2007 (JP) ..... 2007-251576

(51) Int. Cl.
*H01P 1/203* (2006.01)

(52) U.S. Cl.
USPC ..... 333/204; 333/26

(58) Field of Classification Search
USPC ..... 333/4, 26, 136, 204, 205, 219, 235
See application file for complete search history.

(56) References Cited

U.S. PATENT DOCUMENTS

| | | | | |
|---|---|---|---|---|
| 5,376,908 | A * | 12/1994 | Kawaguchi et al. | 333/203 |
| 2005/0052262 | A1 | 3/2005 | Fukunaga et al. | |
| 2007/0024398 | A1 | 2/2007 | Fukunaga | |
| 2007/0171004 | A1 * | 7/2007 | Kayano | 333/204 |

FOREIGN PATENT DOCUMENTS

| | | | |
|---|---|---|---|
| JP | 11-88009 | A | 7/1989 |
| JP | 2004-180032 | A | 6/2004 |
| JP | 2005-80248 | A | 3/2005 |
| JP | 2007-60618 | A | 3/2007 |

OTHER PUBLICATIONS

Li, K. et al., "An Ultra-Wideband Bandpass Filter Using Broadside-Coupled Microstrip-Coplanar Waveguide Structure", Proceedings of the IEICE General Conference, Mar. 2005, C-2-114, pp. 147.

* cited by examiner

*Primary Examiner* — Benny Lee
*Assistant Examiner* — Gerald Stevens
(74) *Attorney, Agent, or Firm* — Birch, Stewart, Kolasch & Birch, LLP

(57) ABSTRACT

A bandpass filter for a wide frequency band such as UWB is disclosed. The bandpass filter can receive a pair of signals, namely a differential signal, and output a single signal, namely an unbalanced signal. A transmission characteristic of the bandpass filter having an attenuation pole near both sides of the passband can be achieved.

7 Claims, 20 Drawing Sheets

BANDPASS FILTER, WIRELESS COMMUNICATION MODULE AND WIRELESS COMMUNICATION DEVICE

CROSS-REFERENCE TO RELATED APPLICATION

The present application is a continuation in part based on PCT Application No. JP2008/132892, filed on Mar. 19, 2008, which claims the benefit of Japanese Application No. 2007-108036, filed on Apr. 17, 2007, and Japanese Application No. 2007-251576, filed on Sep. 27, 2007 both entitled "BANDPASS FILTER, WIRELESS COMMUNICATION MODULE AND WIRELESS COMMUNICATION DEVICE USING SAME". The contents of which are incorporated by reference herein in their entirety.

FIELD OF THE INVENTION

Embodiments of the present invention relate generally to bandpass filters, and more particularly relate to a bandpass filter with a wide band suitable for UWC (Ultra Wide Band) and with attenuation at both sides of the band.

BACKGROUND

In recent years, an Ultra Wide Band (UWB) has drawn attention as a new communication means. UWB transmits amounts of data using a broad frequency band over a short distance such as 10 m or 33 feet. A frequency band of 3.1 to 10.6 GHz, for example, is subjected to use for UWB according to the rule of U.S. FCC (Federal Communication Commission). As such, a feature of UWB is to utilize a broad frequency band. Japan and the ITU-R have a plan to introduce standards separated into a low band of about 3.1 to 4.7 GHz and a high band of about 6 GHz to 10.6 GHz to avoid a band of 5.3 GHz that is used in the IEEE802.11a standard. Accordingly, a low band filter requires the characteristic of being abruptly attenuated at 2.5 GHz and 5.3 GHz.

Therefore, there is a need for a bandpass filter which can receive a differential signal and is applicable for a UWB, and which has an attenuation pole near both sides of the passband in the bandpass characteristic of the bandpass filter.

SUMMARY

A bandpass filter for a wide frequency band such as UWB is disclosed. The bandpass filter can receive a pair of signals, namely a differential signal, and output a single signal, namely an unbalanced signal. A transmission characteristic of the bandpass filter having an attenuation pole near both sides of the passband can be achieved.

A first embodiment comprises a bandpass filter. The bandpass filter comprises a laminate, a ground electrode on or in the laminate, a first ½ wavelength resonant electrode and a second ½ wavelength resonant electrode, a first ¼ wavelength resonant electrode, a second ¼ wavelength resonant electrode, a first input coupling electrode, a second input coupling electrode, a third coupling electrode and a fourth coupling electrode. The laminate comprises a plurality of dielectric layers. The first ½ wavelength resonant electrode is in a first inter-layer portion of the laminate, and has a strip shape and two open ends. The second ½ wavelength resonant electrode is in the first inter-layer portion of the laminate, is in parallel with the first ½ wavelength resonant electrode, has a strip shape and two open ends, and is operable to output or input an unbalanced signal to an external circuit. The first ¼ wavelength resonant electrode is between a first half portion including a first open end of the first ½ wavelength resonant electrode and a first half portion including a first open end of the second ½ wavelength resonant electrode in the first inter-layer portion, has a strip shape, comprises a ground end and an open end, is in parallel to the first half portion of the first ½ wavelength resonant electrode and the first half portion of the second ½ wavelength resonant electrode, and is sandwiched by the first half portion of the first ½ wavelength resonant electrode and the first half portion of the second ½ wavelength resonant electrode. A second ¼ wavelength resonant electrode is between a second half portion including a second open end of the first ½ wavelength resonant electrode and a second half portion including a second open end of the second ½ wavelength resonant electrode in the first inter-layer portion, has a strip shape, comprising a ground end and an open end, is in parallel to the second half portion of the first ½ wavelength resonant electrode and the second half portion of the second ½ wavelength resonance electrode, and is sandwiched by the second half portion of the first ½ wavelength resonant electrode and the second half portion of the second ½ wavelength resonance electrode. A first coupling electrode in a second inter-layer portion of the laminate, has a strip shape, faces the first half portion of the first ½ wavelength resonance electrode, comprises a first connection point which faces a part of a half portion of the first half portion of the first ½ wavelength resonant electrode at the first open end side, and is operable to input or output one half of a differential signal. A second coupling electrode in the second inter-layer portion, has a strip shape, faces the second half portion of the first ½ wavelength resonance electrode, comprises a second connection point which faces a part of a half portion of the second half portion of the first ½ wavelength resonant electrode at the second open end side and is operable to input or output the other half of the differential signal. A third coupling electrode is in the second inter-layer portion, has a strip shape, and faces the first half portion of the second ½ wavelength resonance electrode. A fourth coupling electrode is in the second inter-layer portion, has a strip shape, and faces the second half portion of the second ½ wavelength resonance electrode.

A second embodiment comprises a bandpass filter. The bandpass filter comprises a laminate, a ground electrode on or in the laminate, a first ½ wavelength resonant electrode, a second ½ wavelength resonant electrode, a first ¼ wavelength resonant electrode, a second ¼ wavelength resonant electrode, a third ¼ wavelength resonant electrode, a fourth ¼ wavelength resonant electrode, a first coupling electrode, a second coupling electrode, a third coupling electrode, a fourth coupling electrode and a resonant electrode coupling conductor. The laminate comprises a plurality of dielectric layers. The first ½ wavelength resonant electrode is in a first inter-layer portion of the laminate, and has a strip shape and two open ends. The second ½ wavelength resonant electrode is in the first inter-layer portion of the laminate, is in parallel with the first ½ wavelength resonant electrode, and has a strip shape and two open ends. The third ¼ wavelength resonant electrode is located between a first half portion including a first open end of the first ½ wavelength resonant electrode and a first half portion including a first open end of the second ½ wavelength resonant electrode in the first inter-layer portion, has a strip shape, faces and is operable to be electromagnetically coupled to both the first half portion of the first ½ wavelength resonant electrode and the first half portion of the second ½ wavelength resonant electrode, and comprises a third ground end and a third open end. The third ground end is closer to the first open end of the first ½ wavelength resonant electrode and the first open end of the second ½ wavelength resonant electrode than the third open end. The fourth ¼ wavelength resonant electrode is located between a second half portion including a second open end of the first ½ wavelength resonant electrode and a second half portion including a second open end of the second ½ wavelength resonant electrode in the first inter-layer portion of the laminate, has a strip shape, faces and is operable to be electromagnetically coupled to both the second half portion of the first ½ wavelength resonant electrode and the second half portion of the second ½ wavelength resonant electrode, and comprises a fourth ground end and a fourth open end. The fourth ground end is closer to the second open end of the first ½ wavelength resonant electrode and the second open end of the second ½ wavelength resonant electrode than the fourth open end. The first ¼ wavelength resonant electrode in the first inter-layer portion of the laminate, is located at the other side of the third ¼ wavelength resonant electrode with respect to the first ½ wavelength resonant electrode, has a strip shape, faces and is operable to be electromagnetically coupled to the first half portion of the first ½ wavelength resonant electrode, and comprising a first ground end and a first open end. The first ground end is closer to the first open end of the first ½ wavelength resonant electrode than the first open end. The second ¼ wavelength resonant electrode in the first inter-layer portion of the laminate, is located at the other side of the fourth ¼ wavelength resonant electrode with respect to the first ½ wavelength resonant electrode, has a strip shape, faces and is operable to be electromagnetically coupled to the second half portion of the first ½ wavelength resonant electrode, and comprising a second ground end and a second open end. The second ground end is closer to the second open end of the second ½ wavelength resonant electrode than the second open end. The first coupling electrode is in a second inter-layer portion of the laminate, has a strip shape, faces the first ¼ wavelength resonant electrode, and comprises a first connection point which faces a part of the first open end side from the center of the first ¼ wavelength resonant electrode. The second coupling electrode is in the second inter-layer portion, has a strip shape, and faces the second ¼ wavelength resonant electrode, and comprises a second connection point which faces a part of the second open end side from the center of the second ¼ wavelength resonant electrode. The third coupling electrode is in the second inter-layer portion, has a strip shape, and faces the first half portion of the second ½ wavelength resonant electrode. The fourth coupling electrode is in the second inter-layer portion, has a strip shape, and faces the second half portion of the second ½ wavelength resonant electrode. The resonant electrode coupling conductor is in the fourth inter-layer portion of the laminate which is the opposite side of the second inter-layer portion with respect to the first inter-layer portion, and comprises a first coupling portion, a second coupling portion and a third coupling portion. The first coupling portion comprising a first end, which is connected to the ground potential close to the first ground end of the first ¼ wavelength resonant electrode, and faces and operable to be electromagnetically coupled to at least a part of the first ¼ wavelength resonant electrode. The second coupling portion comprises an end, which is connected to the ground potential close to the second ground end of the second ¼ wavelength resonant electrode, and faces and is operable to be electromagnetically coupled to at least a part of the second ¼ wavelength resonant electrode. The third coupling portion faces and is operable to be electromagnetically coupled to at least a center part of the second ½ wavelength resonant electrode.

A third embodiment comprises a wireless communication module. The wireless communication module comprises a RF module which comprises a bandpass filter and a base band module connected to the RF module.

A fourth embodiment comprises a wireless communication device. The wireless communication device a RF module comprising a bandpass filter, a base band module connected to the RF module and an antenna connected to the bandpass filter.

BRIEF DESCRIPTION OF THE DRAWINGS

Embodiments of the present invention are hereinafter described in conjunction with the following figures, wherein like numerals denote like elements. The figures are provided for illustration and depict exemplary embodiments of the invention. The figures are provided to facilitate understanding of the invention without limiting the breadth, scope, scale, or applicability of the invention. The drawings are not necessarily made to scale.

DETAILED DESCRIPTION OF EXEMPLARY EMBODIMENTS

The following description is presented to enable a person of ordinary skill in the art to make and use the embodiments of the disclosure. The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the invention. Furthermore, there is no intention to be bound by any expressed or implied theory presented in the preceding technical field, background, brief summary or the following detailed description. The present disclosure should be accorded scope consistent with the claims, and not limited to the examples described and shown herein.

Embodiments of the disclosure are described herein in the context of practical non-limiting applications, namely, bandpass filters. Embodiments of the disclosure, however, are not limited to such bandpass filters, and the techniques described herein may also be utilized in other filter applications. For example, embodiments are not limited to a wide bandpass filter and may be applicable to a wireless communication module, wireless communication device, and the like.

As would be apparent to one of ordinary skill in the art after reading this description, these are merely examples and the embodiments of the disclosure are not limited to operating in accordance with these examples. Other embodiments may be utilized and structural changes may be made without departing from the scope of the exemplary embodiments of the present disclosure.

Figure 1:
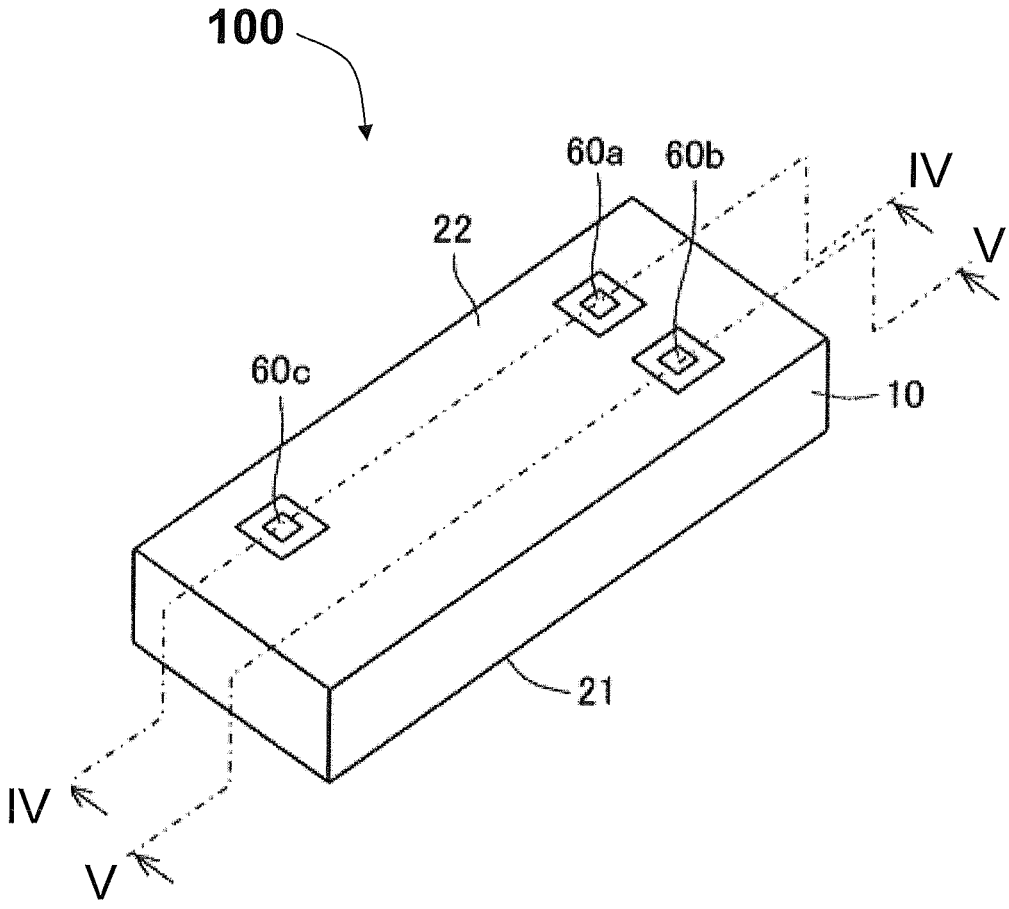
FIG. 1 is a perspective view schematically illustrating the external appearance of a bandpass filter according to one embodiment of the present invention.
Figure 2:
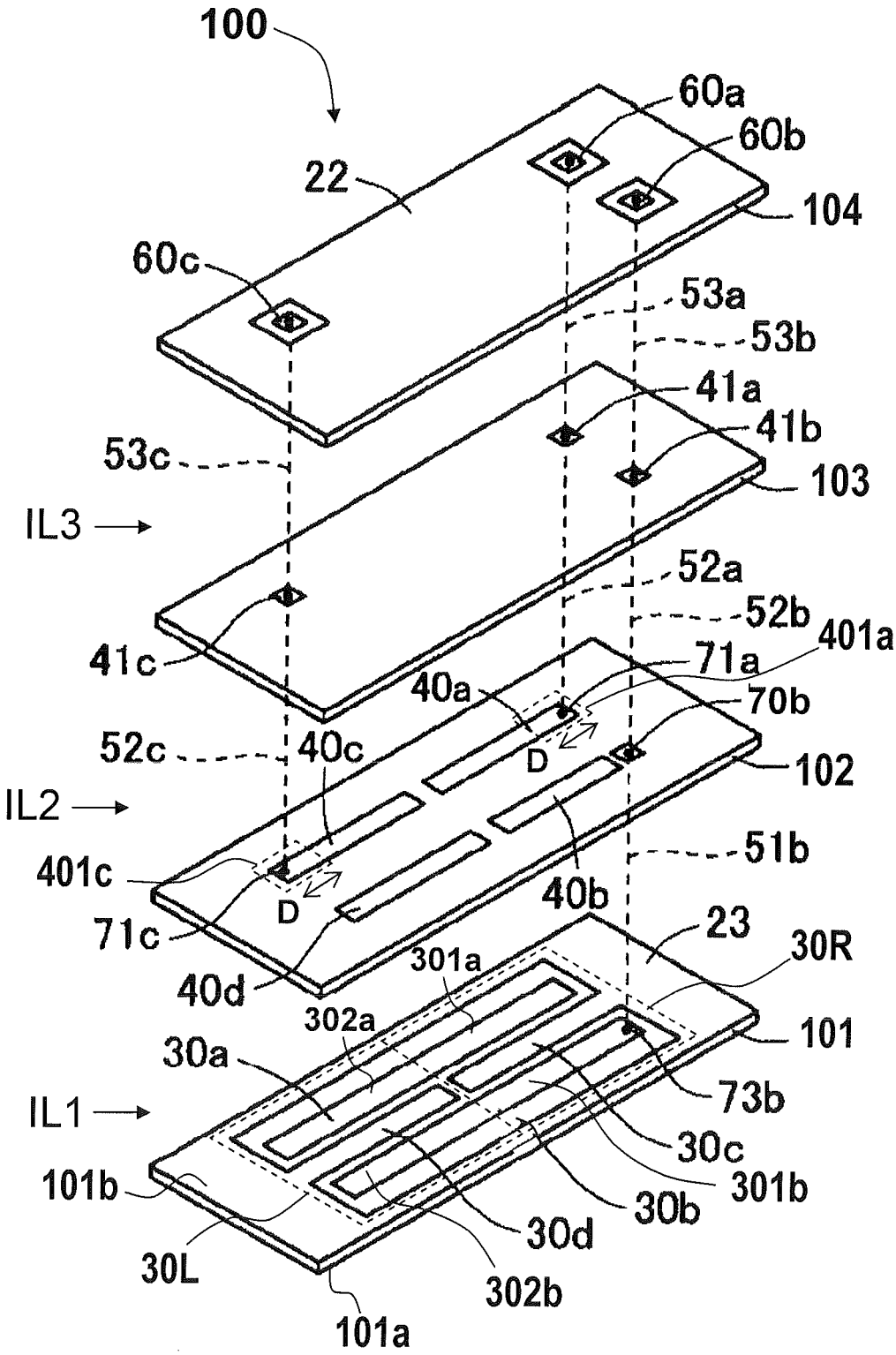
FIG. 2 is an exploded perspective view schematically illustrating the bandpass filter shown in FIG. 1.
Figure 3A:
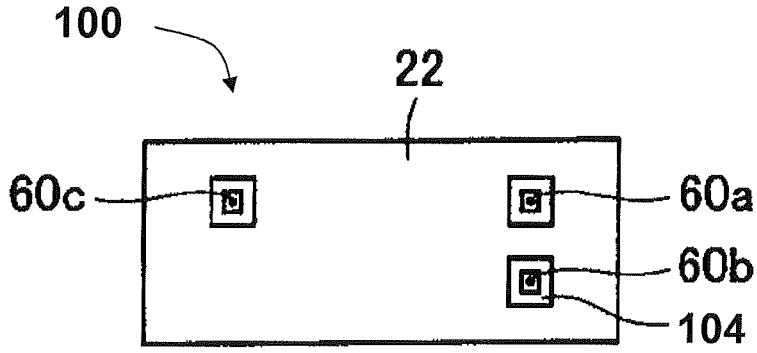
FIG. 3A is a plan view schematically illustrating a top surface of the bandpass filter shown in FIG. 1.
Figure 3B:
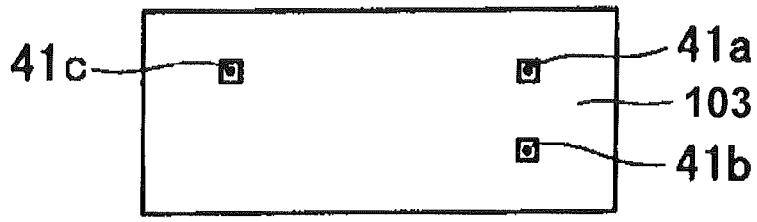
FIG. 3B to 3D are plan views schematically illustrating inter-layers of the bandpass filter shown in FIG. 1.
Figure 3C:
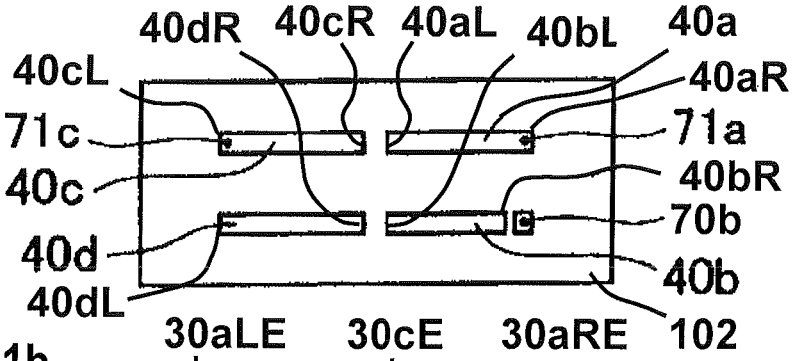
Figure 3D:
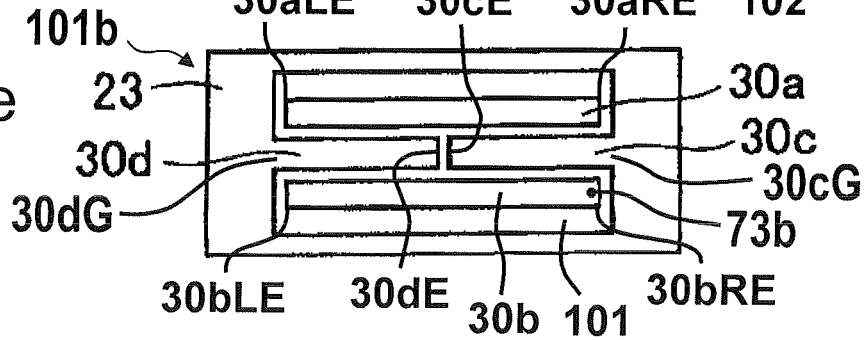
Figure 3E:
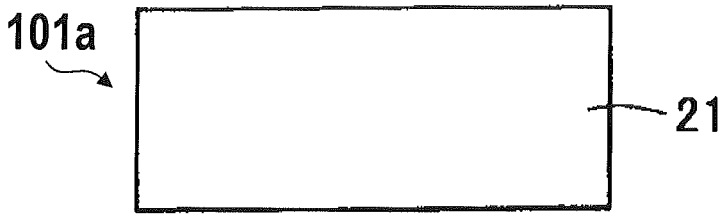
FIG. 3E is a plan view schematically illustrating a bottom surface of the bandpass filter shown in FIG. 1.
Figure 4:
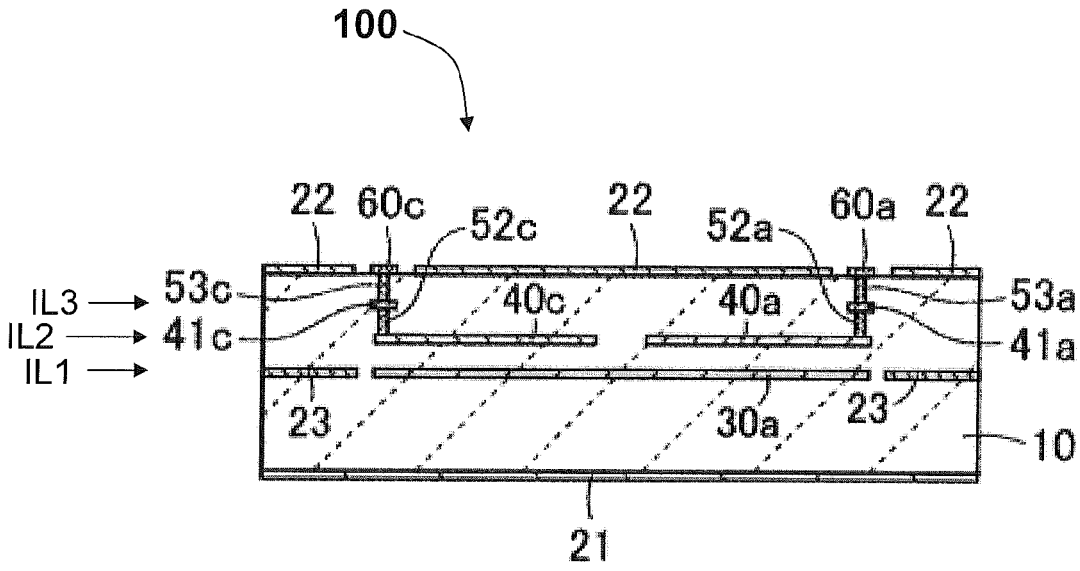
FIG. 4 is a cross sectional view taken along the line IV-IV shown in FIG. 1.
Figure 5:
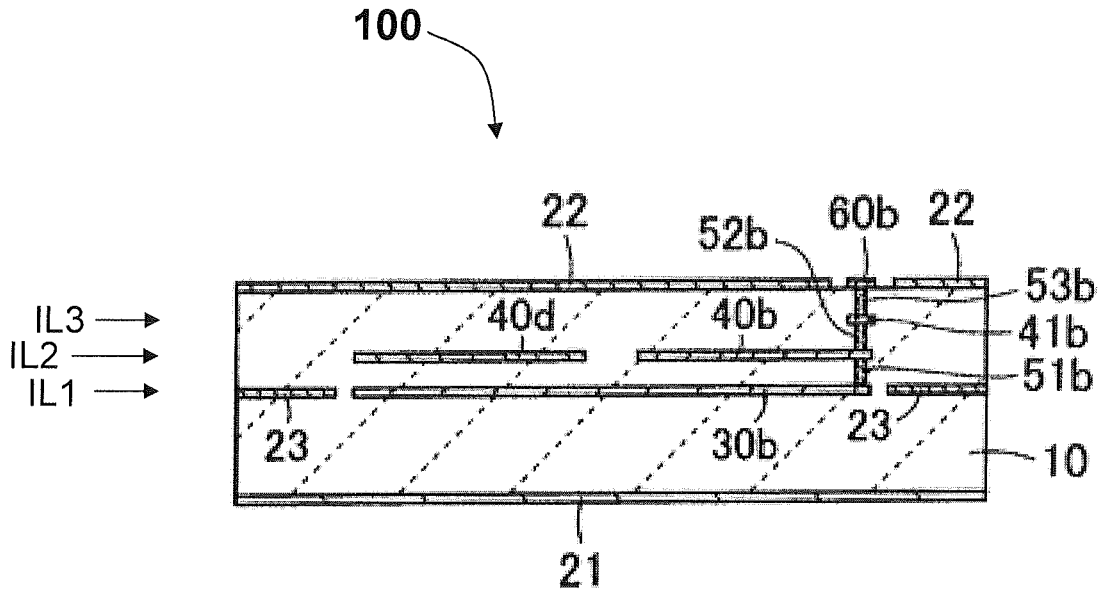
FIG. 5 is a cross sectional view taken along the line V-V shown in FIG. 1.

FIG. 1 is a perspective view schematically illustrating the external appearance of a bandpass filter according to one embodiment of the present invention. FIG. 2 is an exploded perspective view schematically illustrating the bandpass filter shown in FIG. 1. FIG. 3A is a plan view schematically illustrating a top surface of the bandpass filter shown in FIG. 1. FIG. 3B to 3D are plan views schematically illustrating inter-layers of the bandpass filter shown in FIG. 1. FIG. 3E is a plan view schematically illustrating a bottom surface of the bandpass filter shown in FIG. 1. FIG. 4 is a cross sectional view taken along the line IV-IV shown in FIG. 1. FIG. 5 is a cross sectional view taken along the line V-V shown in FIG. 1.

The bandpass filter 100 according to one embodiment of the present invention comprises a laminate 10. The laminate 10 comprises a plurality of dielectric layers 101, 102, 103 and 104 which are laminated. In other words, the laminate 10 comprises a plurality of inter-layers IL1, IL2 and IL3. IL1 is located between the dielectric layer 101 and 102, IL2 is located between the dielectric layer 102 and 103 and IL3 is located between the dielectric layer 103 and 104. The number of the dielectric layers is not limited to 4. Some of dielectric layers may be shown and the other may not be shown in the figures.

The bandpass filter 100 may comprise a first ground electrode 21, a second ground electrode 22. In addition, the bandpass filter 100 may comprise an annular ground electrode 23. These ground electrodes 21, 22 and 23 are connected to a ground potential.

The first ground electrode 21 is located on the bottom surface of the laminate 10. In other words, the first ground electrode 21 is disposed on a lower surface 101*a* of the dielectric layer 101. The first ground electrode 21 can, without limitation, cover the entire surface of the lower surface 101*a*. In an embodiment, one or more additional dielectric layers (not shown) may be arranged under the first ground electrode 21 to sandwich the first ground electrode 21 with the dielectric layer 101.

The second ground electrode 22 is located on the top surface of the laminate 10. In other words, the second ground electrode 22 is disposed on an upper surface of the dielectric layer 104. In an embodiment, one or more additional dielectric layers (not shown) may be attached on the second ground electrode 22 to sandwich the second ground electrode 21 with the dielectric layer 104. That is, the first ground electrode 21 and/or the second ground electrode 22 can be inside the laminate 10. The second ground electrode 22 can, without limitation, cover the entire surface of the upper surface of the dielectric layer 104 except a first input terminal electrode 60*a*, an output terminal electrode 60*b*, a second input terminal electrode 60*c* and their peripheries.

The bandpass filter 100 further comprises an input resonant electrode 30*a* (first ½ wavelength resonant electrode), an output resonant electrode 30*b* (second ½ wavelength resonant electrode), a first central resonant electrode 30*c* (first ¼ wavelength resonant electrode) and a second central resonant electrode 30*d* (second ¼ wavelength resonant electrode). Hereinafter, a group of the input resonant electrode 30*a*, the output resonant electrode 30*b*, the first central resonant electrode 30*c* and the second central resonant electrode 30*d* may be called as resonant electrodes 30*a*, 30*b*, 30*c* and 30*d*. Each of the resonant electrodes 30*a*, 30*b*, 30*c* and 30*d* can have strip shapes.

The resonant electrodes 30*a*, 30*b*, 30*c* and 30*d* are arranged in parallel each other in the longitudinal direction on the dielectric layer 101. The resonant electrodes 30*a*, 30*b*, 30*c* and 30*d* are separated each other by a predetermined distance or interval. The first and second central resonant electrodes 30*c* and 30*d* are located between the input resonant electrode 30*a* and the output resonant electrode 30*b*.

The resonant electrodes 30*a*, 30*b*, 30*c* and 30*d* are located on upper surface 101*b* of the dielectric layer 101 of the laminate 10. This surface may be referred to a first inter-layer portion IL1 of the laminate 10.

Both of the first ground electrode 21 and the second ground electrode 22 are connected to the ground potential, and therefore, the first ground electrode 21 and the second ground electrode 22 constitute a strip line resonator along with the resonant electrodes 30*a*, 30*b*, 30*c* and 30*d*.

The bandpass filter 100 further comprises a first input coupling electrode 40*a* (or a first coupling electrode), a first output coupling electrode 40*b* (or a third coupling electrode), a second input coupling electrode 40*c* (or a second coupling electrode) and a second output coupling electrode 40*d* (or a fourth coupling electrode). Hereinafter, a group of the first input coupling electrode 40*a*, the first output coupling electrode 40*b*, the second input coupling electrode 40*c* and the second output coupling electrode 40*d* may be called as coupling electrodes 40*a*, 40*b*, 40*c* and 40*d*. Each of the coupling electrodes 40*a*, 40*b*, 40*c* and 40*d* can have strip shapes.

The coupling electrodes 40*a*, 40*b*, 40*c* and 40*d* are located on the surface of a dielectric layer 102 of the laminate 10. This surface may be referred to a second inter-layer portion IL2 of the laminate 10.

The bandpass filter 100 may comprise a first connecting electrode 41*a*, a second connecting electrode 41*b* and a third connecting electrode 41*c*. Hereinafter, a group of the first connecting electrode 41*a*, the second connecting electrode 41*b* and the third connecting electrode 41*c* and may be called as connecting electrodes 41*a*, 41*b* and 41*c*. The bandpass filter 100 may also comprise an output connecting electrode 70*b*.

The connecting electrodes 41*a*, 41*b* and 41*c* are located on the surface of a dielectric layer 103 of the laminate 10. This surface may be referred to a third inter-layer portion IL3 of the laminate. In contrast, the output connecting electrode 70*b* is located on the surface of a dielectric layer 102 of the laminate 10. This surface may be referred to a third inter-layer portion IL2 of the laminate.

The bandpass filter 100 may comprise a first input terminal electrode 60*a*, an output terminal electrode 60*b* and a second input terminal 60*c*. Hereinafter, a group of the first input terminal electrode 60*a*, the output terminal electrode 60*b* and the second input terminal 60*c* may be called as terminal electrodes 60*a*, 60*b* and 60*c*. The terminal electrodes 60*a*, 60*b* and 60*c* are located on the top surface of the laminate 10. In other words, the terminal electrodes 60*a*, 60*b* and 60*c* are located on the upper surface of a dielectric layer 104.

The output resonant electrode 30*b* is connected to the output connecting electrode 70*b* by a penetration conductor 51*b* which penetrates the dielectric layer 102.

The first connecting electrode 41*a* is connected to the first input coupling electrode 40*a* by a penetration conductor 52*a* which penetrates the dielectric layer 103. The second connecting electrode 41*b* is connected to the output connecting electrode 70*b* by a penetration conductor 52*b* which penetrates the dielectric layer 103. The third connecting electrode 41*c* is connected to the second input coupling electrode 40*c* by a penetration conductor 52*c* which penetrates the dielectric layer 103.

The terminal electrodes 60*a*, 60*b* and 60*c* face the connecting electrodes 41*a*, 41*b* and 41*c*, respectively. The first input terminal electrode 60*a* is connected to the first connecting electrode 41*a* by a penetration conductor 53*a* which penetrates the dielectric layer 104. The output terminal electrode 60*b* is connected to the second connecting electrode 41*b* by a penetration conductor 53*b* which penetrates the dielectric layer 104. The second input terminal electrode 60*c* is connected to the third connecting electrode 41*c* by a penetration conductor 53*c* which penetrates the dielectric layer 104.

The input resonant electrode 30*a* can serve as a ½ wavelength resonator. The input resonance electrode 30*a* is equivalent to two ¼ resonant electrodes (i.e., 301*a* and 302*a*), each of which serves as a ¼ wavelength resonator, arranged in a longitudinal direction. In the same manner, the output resonant electrode 30*b* can serve as a ½ wavelength resonator. The output resonant electrode 30*b* is equivalent to two ¼ resonant electrodes (i.e., 301*b* and 302*b*), each of which serves as a ¼ wavelength resonator, arranged in a longitudinal direction.

The input resonant electrode 30*a* comprises two open ends, a right end 30*a*RE and a left end 30*a*LE. The output resonant electrode 30*b* comprises two open ends, a right end 30*b*RE and a left end 30*b*LE. The first central resonant electrode 30*c* comprises two ends, an open end 30*c*E and a first grand end 30*c*G. The first grand end 30*c*G is connected to the annular ground electrode 23. In the same manner, the second central resonant electrode 30*d* comprises two ends, an open end 30*d*E and a second grand end 30*d*G. The second grand 30*d*G is connected to the annular ground electrode 23. The second open end 30*d*E of the second central resonant electrode 30*d* faces the first open end 30*c*E of the first central resonant electrode 30*c* on their sides.

The length of each of the central resonant electrodes 30*c* and 30*d* may be, without limitation, about 2 to 6 mm if the relative dielectric constant of the dielectric layers 101, 102, 103 and 104 is set on the order of 10 by setting the center frequency as 4 GHz.

The right half portion 301*a* of the input resonant electrode 30*a* corresponding to ¼ wavelength and the right half portion 301*b* of the output resonant electrode 30*b* corresponding to ¼ wave length are operable to be coupled electromagnetically (edge coupled) with the first central resonant electrode 30*c* which is located between the right half portion 301*a* of the input resonant electrode 30*a* and the right half portion 301*b* of the output resonant electrode 30*b*.

In the same manner, the left half portion 302*a* of the resonant electrode 30*a* corresponding to ¼ wave length and the left half portion 302*b* of the output resonant electrode 30*b* corresponding to ¼ wavelength are operable to be coupled electromagnetically (edge coupling) with the second central resonant electrode 30*d* which is located between the left half portion 302*a* of the input resonant electrode 30*a* and the left half portion 302*b* of the output resonant electrode 30*b*.

Accordingly, the right half portion 301*a* of the first resonant electrode 30*a*, the right half portion 301*b* of the output resonant electrode 30*b* and the first central resonant electrode 30*c* are operable to be coupled to each other in an inter-digital type. In the same manner, the left half portion 302*a* of the resonant electrode 30*a*, the left half portion 302*b* of the output resonant electrode 30*b* and the second central resonant electrode 30*d* are coupled to each other in an inter-digital type. Such a coupling is strong because a coupling by magnetic fields is added to a coupling by electric fields.

As the interval between the central resonant electrodes 30*c*, 30*d* and the input resonant electrodes 30*a* becomes narrower, or the interval between the central resonant electrodes 30*c*, 30*d* and the output resonant electrodes 30*b* becomes narrower, the coupling may be stronger. However, if the interval becomes too narrow, the difficulty in manufacturing the resonant electrodes 30*a*, 30*b*, 30*c* and 30*d* may increase. Accordingly, the interval between the resonant electrodes 30*a*, 30*b*, and 30*c* may be set, without limitation, about 0.05 to 0.5 mm.

As such, since the resonant electrodes 30*a*, 30*b*, 30*c* and 30*d* are not only edge-coupled but also coupled to each other in the inter-digital type, the frequency interval between resonance frequencies in each resonance mode is adapted to be appropriate to gain a broad pass band width on the order of 40% by the relative bandwidth which is well in excess of the region that can be realized by the conventional filter using the ¼ wavelength resonator and is appropriate as a bandpass filter for UWB.

In addition, it may not be preferable to make a coupling between the resonant electrodes 30*a*, 30*b*, 30*c* and 30*d* in an inter-digital type and make a broad-side coupling therebetween as well because the coupling may become too strong to achieve the pass band width of about 40% by the relative bandwidth.

The input coupling electrodes 40*a*, 40*c* which are located on the upper surface of the dielectric layer 102, face the input resonant electrode 30*a* of the input stage on the dielectric layer 101, and therefore are operable to be coupled to the input resonant electrode 30*a*.

In other words, the input coupling electrode 40*a* faces the right half portion 301*a* of the first resonant electrode 30*a* in the right half portion 30R of the resonant electrode region, and therefore, is operable to be electromagnetically coupled to the right half portion 301*a* of the first resonant electrode 30*a*. In the same manner, the second input coupling electrode 40*c* faces the left half portion 302*a* of the first resonant electrode 30*a* in the left half portion 30L of the resonant electrode region, and therefore, is operable to be electromagnetically coupled to the left half portion 302*b* of the first resonant electrode 30*a*.

Accordingly, the input coupling electrode 40*a* and the right half portion 301*a* of the first resonant electrode 30*a* are broad-side coupled to each other, and therefore, the coupling becomes stronger than the edge-coupling. Also, the second input coupling electrode 40*c* and the left half portion 302*a* of the first resonant electrode 30*a* are broad-side coupled to each other, and therefore, the coupling becomes stronger than the edge-coupling.

The first input coupling electrode 40*a* is connected to the first input terminal electrode 60*a* on the dielectric layer 104 by the penetration conductors 52*a*, 53*a* via the first connecting electrode 41*a*, while the second input coupling electrode 40*c* is connected to the second input terminal electrode 60*c* on the dielectric layer 104 by the penetration conductors 52*c*, 53*c* via the third connecting electrode 41*c*.

The first input coupling electrode 40*a* comprises a first contact point 71*a*, which is connected to the penetration conductor 52*a*, near an end 40*a*R thereof. The first contact point 71*a* may be located at a region 401*a* which has the length D from the right end 40*a*R of the first input coupling electrode 40*a* in the longitudinal direction. The length D is less than ¼ of the input resonant electrode 30*a*. The first contact point 71*a* may face a point near the right end 30*a*RE of the input resonant electrode 30*a*.

The second input coupling electrode 40*c* comprises a third contact point 71*c*, which is connected to the penetration conductor 52*c*, near an end 40*c*L thereof. The third contact point 71*c* may be located at a region 401*c* which has the length D from the left end 40*a*L of the second input coupling electrode 40*c* in the longitudinal direction. The length D is less than ¼ of the input resonant electrode 30*a*. The third contact point 71*c* faces the left end 30*a*LE of the input resonant electrode 30*a*.

The first input coupling electrode 40*a* comprises an end 40*a*L which is an open end located at the other side of the first contact point 71*a*. The second input coupling electrode 40*c* comprises an end 40*c*R which is an open end located at the other side of the third contact point 71*c*. The ends 40*a*L, 40*c*R are separated and face each other at their sides.

A differential signal (or a pair of electrical signals comprising a first waveform signal and a second waveform signal which are opposite phase with each other) inputted from an external circuit is supplied not only to the first input coupling electrode 40*a* through the first contact point 71*a* but also to the second input coupling electrode 40*c* through the third contact point 71*c*. In other words, a differential signal is supplied to the first input coupling electrode 40*a* and the second input coupling electrode 40*c*. Therefore, the input coupling electrodes 40*a*, 40*c* and the input resonant electrode 30*a* are operable to be coupled to each other in an inter-digital type, respectively, and therefore, a coupling by magnetic fields are added to a coupling by electric fields, so that the coupling becomes stronger than the comb-line type coupling alone or capacitive coupling alone.

As such, since the first input coupling electrode 40*a* can be not only broad-side coupled but also coupled in an inter-digital type with the right half portion 301*a* of the input resonant electrode 30*a*, the input coupling electrode 40*a* ends up to be coupled to the right half portion 301*a* of the input resonant electrode 30*a* strongly. In the same manner, the second input coupling electrode 40*c* can be coupled to the left half portion 302*a* of the input resonant electrode 30*a* strongly.

Similarly, the output coupling electrodes 40*b*, 40*d* are located on the upper surface of the dielectric layer 102, face the output resonant electrode 30*b*, and can be coupled to the output resonant electrode 30*b*.

In other words, the output coupling electrode 40*b* faces the right half portion 301*b* of the output resonant electrode 30*b* in right half portion 30R of the resonant electrode region, and therefore, is operable to be electromagnetically coupled to the right half portion 301*b* of the second resonant electrodes 30*b*. In the same manner, the output coupling electrode 40*d* faces the left half portion 302*b* of the output resonant electrode 30*b* in the left half portion 30L of the resonant electrode region, and therefore, can be electromagnetically coupled to the left half portion 302*b* of the output resonant electrodes 30*b*.

Accordingly, the first output coupling electrode 40*b* and the right half portion 301*b* of the output resonant electrode resonant electrode 30*b* are broad-side coupled to each other, and therefore, the coupling becomes stronger than the edge-coupling. Also, the second output coupling electrode 40*c* and the left half portion 302*b* of the output resonant electrode 30*b* are broad-side coupled to each other, and therefore, the coupling becomes stronger than the edge-coupling.

Further, the first output coupling electrode 40*b* and second output coupling electrode 40*d* are connected to no penetration conductors, and therefore are independent in terms of electric connection.

The first output coupling electrode 40*b* comprises an open end 40*b*L. The second output coupling electrode 40*d* comprises an open end 40*d*R. The open ends Land 40*d*R are separated and face each other at their sides.

The resonant electrode 30*b* comprises an output contact point 73*b*. An unbalanced type electrical signal, which is a single signal, outputting to an external circuit is drawn from the output contact point 73*b*. The output contact point 73*b* is connected to the output terminal electrode 60*b* via penetration conductors 51*b*, 52*b* and 53*b* which are shown as dashed lines in FIG. 2.

The differential signal (balanced type electrical signal) inputted from an external circuit is supplied to the first contact point 71*a* of the first input coupling electrode 40*a* and the third contact point 71*c* of the second input coupling electrode 40*c*. The unbalanced type electrical signal outputted to an external circuit is taken out neither from the first output coupling electrode 40*b* nor from the second output coupling electrode 40*d* but from the output contact point 73*b* of the output resonant electrode 30*b*. Alternatively, the output contact point 73*b* can be located near the left end 30*b*LE of the output resonant electrode 30*b* to face the fourth contact point 72*d* at an area near the open end 40*d*L.

The output contact point 73*b* of the output resonant electrode 30*b* is connected to the output terminal electrode 60*b* via penetration conductors 51*b*, 52*b*, and 53*b*.

A total input power of the differential signal supplied to the first input coupling electrode 40*a* and to the second input coupling electrode 40*c* may be equal to or nearly equal to an output power of the unbalanced type electrical signal taken out from the output contact point 73*b* to an external circuit via the output terminal electrode 60*b*.

A first signal of the differential signal can be inputted from an external circuit to the first terminal electrode 60*a*, and travel to the input resonant electrode 30*b* via the output resonant electrode 30*a* where the input resonant electrode 30*a* and the output resonant electrode 30*b* are electromagnetically coupled with the first central resonant electrode 30*c*. A second signal having an antiphase signal of the differential signal can be inputted from the external circuit to the first terminal electrode 60*c*, and traveled to the input resonant electrode 30*b* via the output resonant electrode 30*a* where the input resonant electrode 30*a* and the output resonant electrode 30*b* are electromagnetically coupled with second central resonant electrode 30*d*. Then both of the first signal and the second signal are combined at the output resonant electrode 30*b* in the same phase to form an unbalanced type electric signal to be taken out.

Since the input coupling electrodes 40*a*, 40*c* and the first resonant electrode 30*a* of the input stage can be coupled to each other strongly and the output coupling electrodes 40*b*, 40*d* and the second resonant electrode 30*b* of the output stage are operable to be coupled to each other strongly, a bandpass filter may be obtained, whose insertion loss is not greatly increased at frequencies located between resonance frequencies in each resonance mode even in the broad pass band width well in excess of the region that may be achieved by the conventional filter using the ¼ wavelength resonator, and which has a flat and low-loss transmission characteristic over the entire region of the broad pass band.

In one embodiment, the shape dimensions of the input coupling electrodes 40*a*, 40*c* may be set to be substantially equal to the half portion of the first resonant electrode 30*a*. In other words, if the input coupling electrodes 40*a*, 40*c* are arranged next each other in the same direction, the total shape dimension of the input coupling electrodes 40*a*, 40*c* is substantially identical to the first resonant electrode 30*a*. Similarly, if the output coupling electrodes 40*b*, 40*d* are arranged next each other in the same direction, the total shape dimension of the input coupling electrodes 40*b*, 40*d* is substantially identical to the second resonant electrode 30*b*.

In FIGS. 2 and 3, the first input coupling electrode 40*a* and the first output coupling electrode 40*b* look different in length. However, these can be the same length. The output connecting electrode 70*b* is shown in an exaggerated fashion for explanation.

As the interval between the input coupling electrodes 40*a*, 40*c* and the first resonant electrode 30*a* of the input stage, and the interval between the output coupling electrodes 40*b*, 40*d* and the second resonant electrode 30*b* of the output stage are smaller, the coupling may become stronger but they may become difficult to be manufactured. Therefore, the intervals may be set, for example and without limitation, to about 0.01 to 0.5 mm.

The annular ground electrode 23 having a ring shape is located on the upper surface 101*b* of the dielectric layer 101 of the laminate 10. The annular ground electrode 23 surrounds resonant electrodes which comprises the input resonant electrodes 30*a*, the output resonant electrode 30*b*, the first central resonant electrode 30*c* and the second central resonant electrode 30*d*. The annular ground electrode 23 is connected to one end (ground end) of each of the central resonant electrodes 30*c* and 30*c*.

Since the annular ground electrode 23 is connected to the ground potential, the ground end 30*c*G of the first central resonant electrode 30*c* and the ground end 30*d*G of the second central resonant electrode 30*d*, which are connected to the annular ground electrode 23, can be connected to the ground potential.

In addition, the annular ground electrode 23 reduces the electromagnetic wave generated by the resonant electrodes 30*a*, 30*b*, 30*c* and 30*d* to spread out from the filter. This may be effective to reduce the negative effect on other electrical units in a module which comprises a bandpass filter therein.

In one embodiment, the input terminal electrodes 60*a*, 60*c* and output terminal electrode 60*b* may be omitted if, for example and without limitation, a bandpass filter is formed inside of a module substrate.

Figure 6:
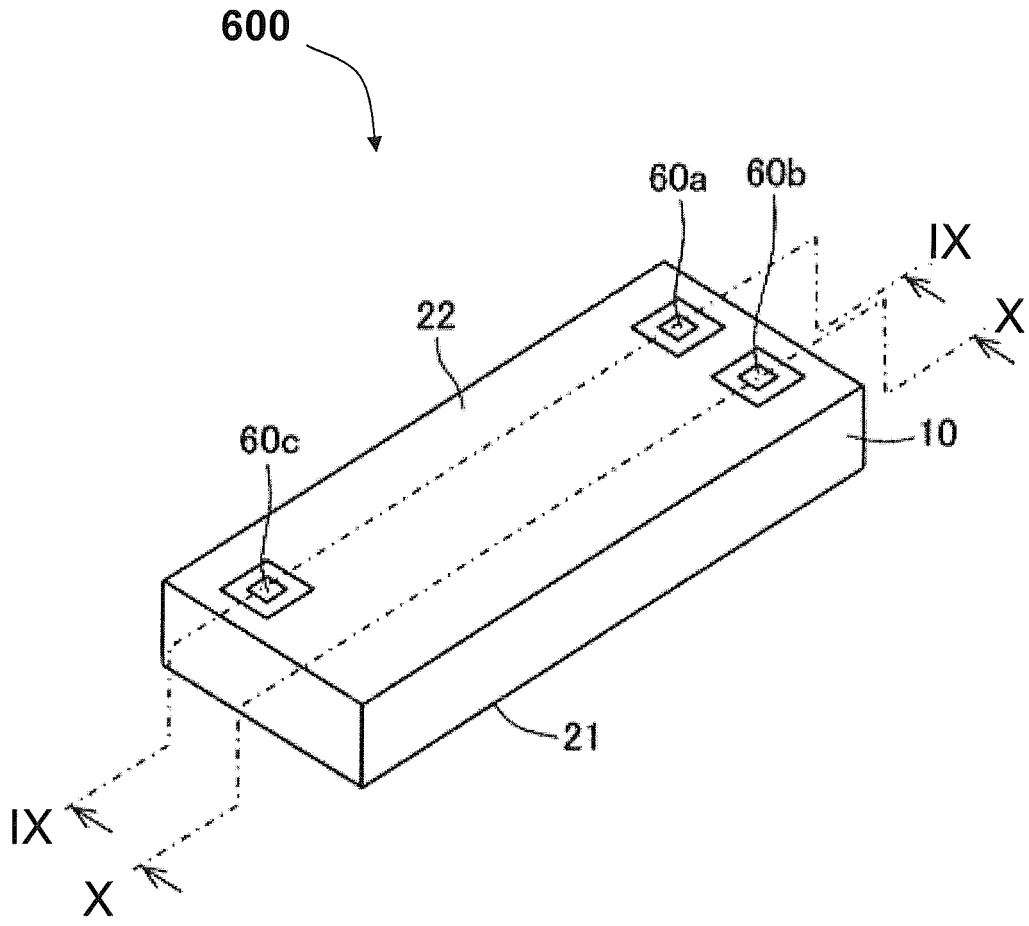
FIG. 6 is a perspective view schematically illustrating the external appearance of a bandpass filter according to one embodiment of the present invention.
Figure 7:
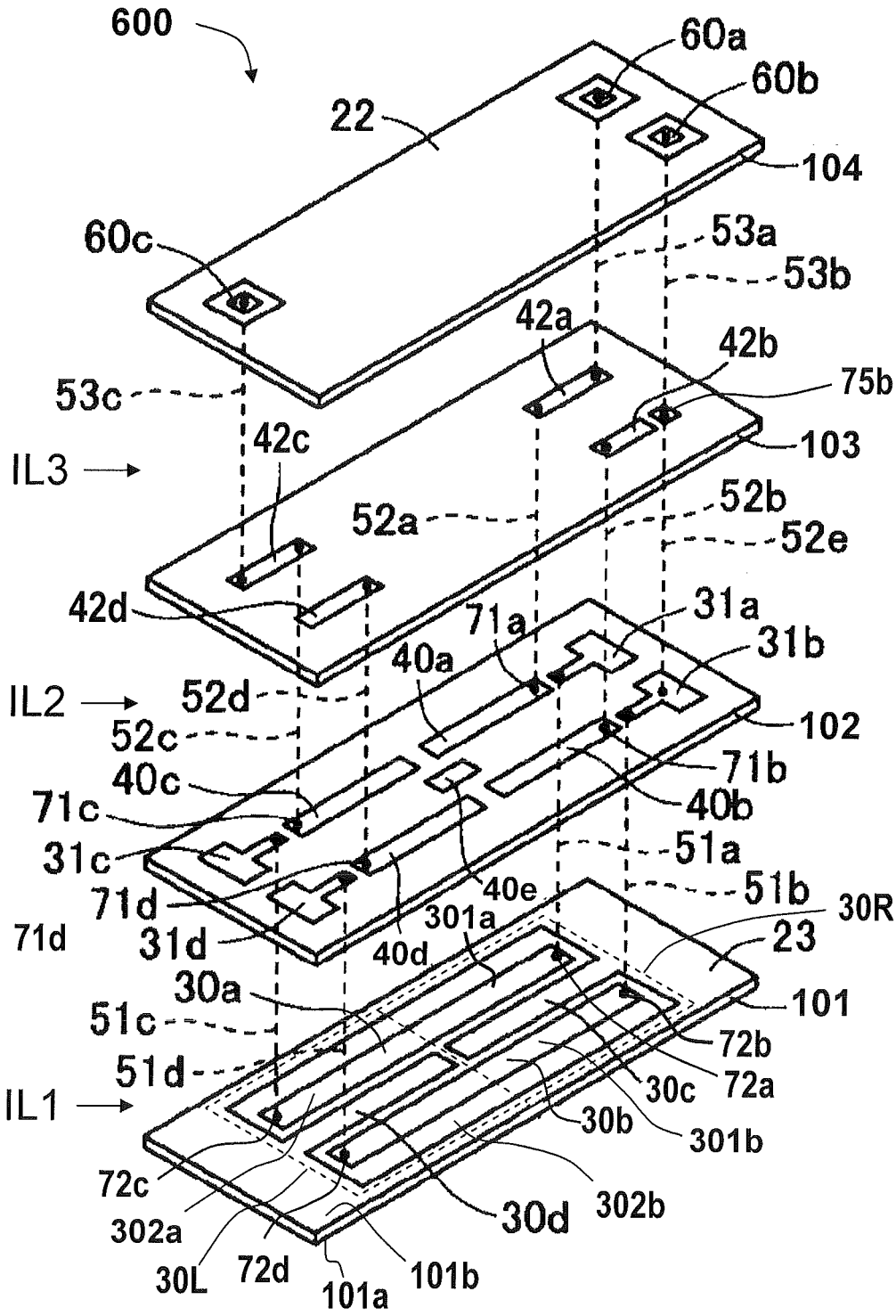
FIG. 7 is an exploded perspective view schematically illustrating the bandpass filter shown in FIG. 6.
Figure 8A:
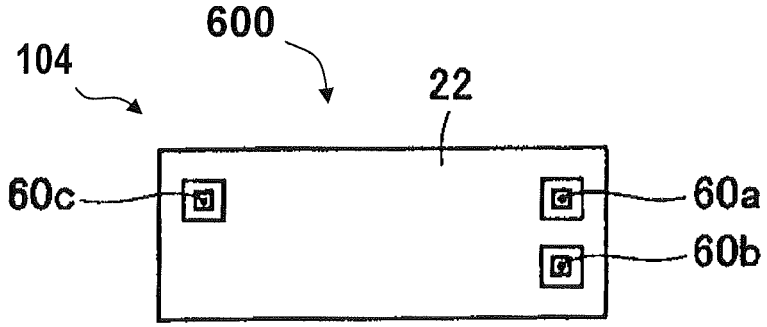
FIG. 8A is a plan view schematically illustrating a top surface of the bandpass filter shown in FIG. 6.
Figure 8B:
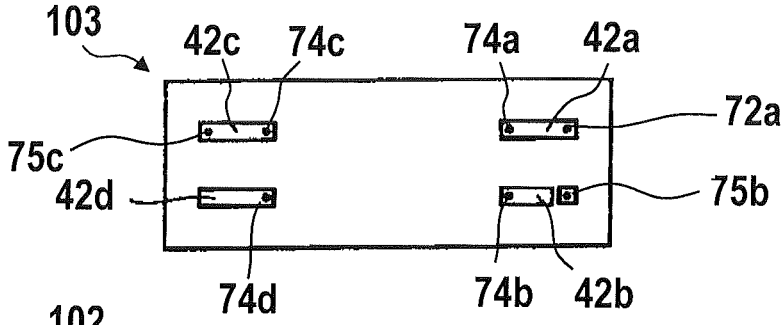
FIG. 8B to 8D are plan views schematically illustrating inter-layers of the bandpass filter shown in FIG. 6.
Figure 8C:
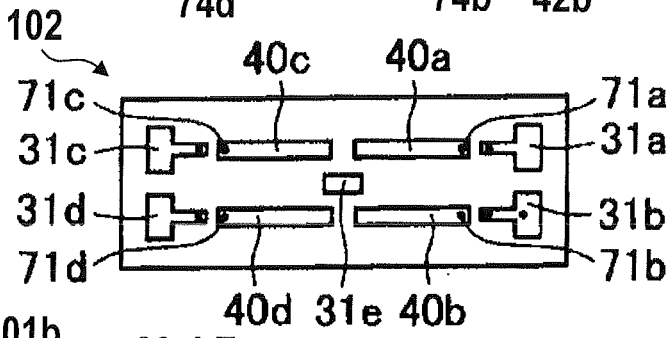
Figure 8D:
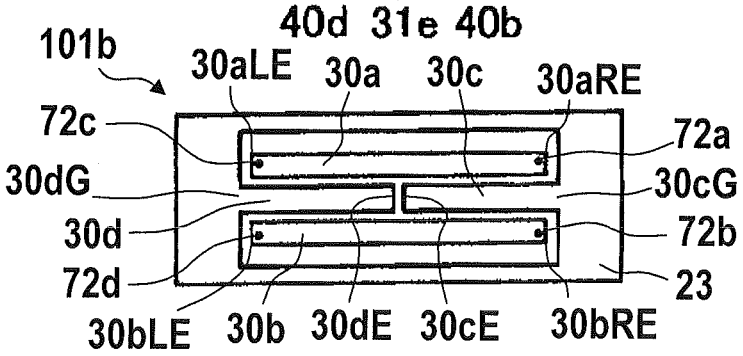
Figure 8E:
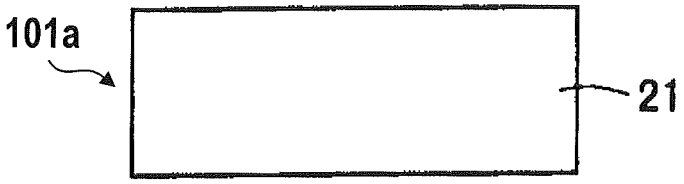
FIG. 8E is a plan view schematically illustrating a bottom surface of the bandpass filter shown in FIG. 6.
Figure 8F:
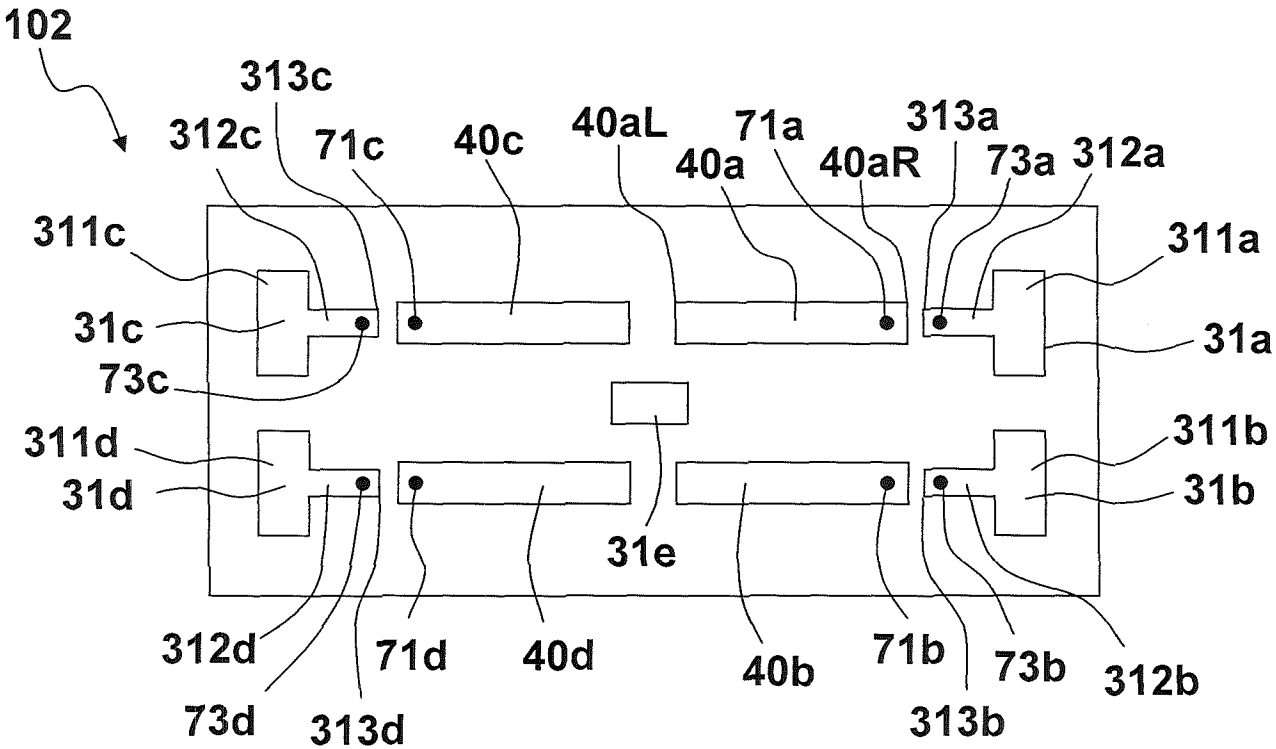
FIG. 8F is an enlarged plan view of FIG. 8C.
Figure 9:
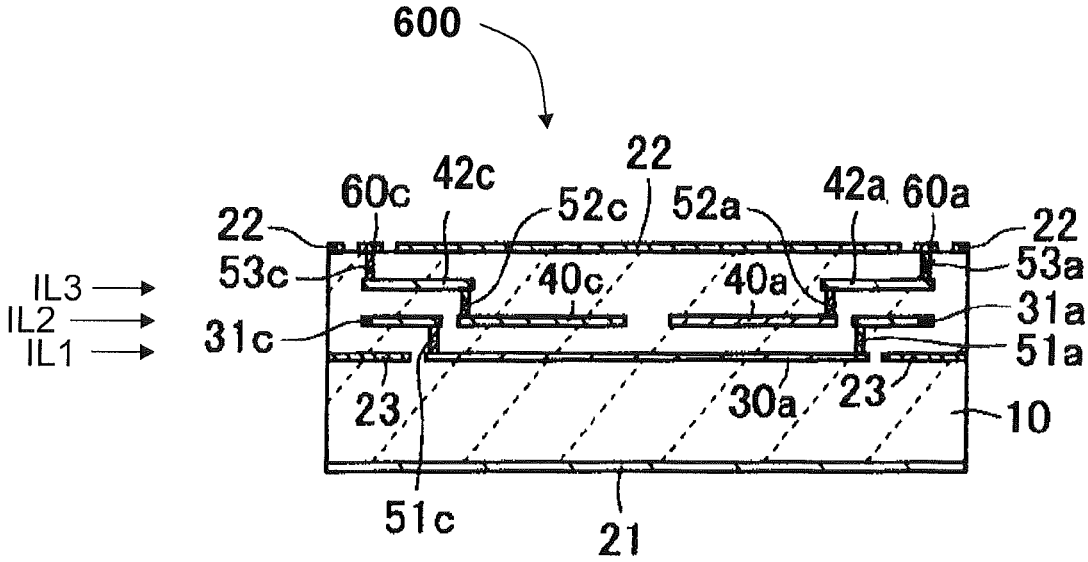
FIG. 9 is a cross sectional view taken along the line IX-IX shown in FIG. 6.
Figure 10:
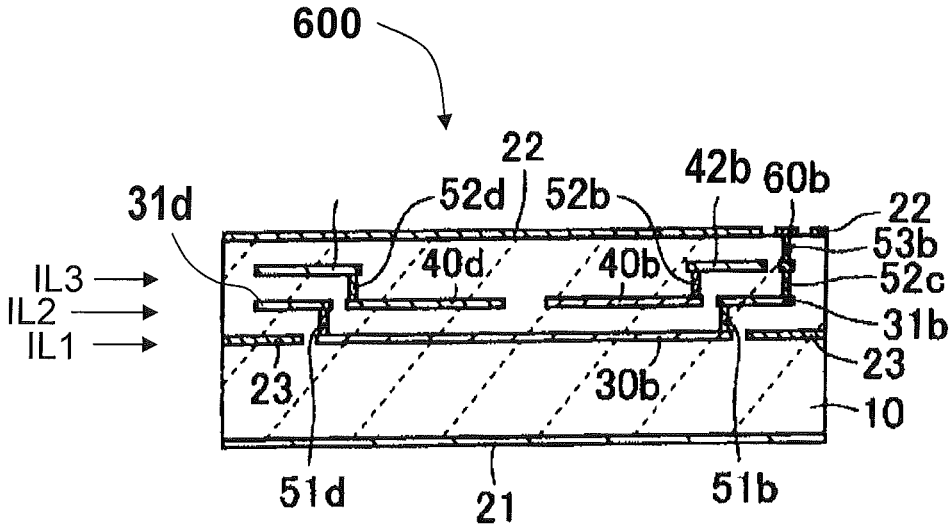
FIG. 10 is a cross sectional view taken along the line X-X shown in FIG. 6.

FIG. 6 is a perspective view schematically illustrating the external appearance of a bandpass filter according to an embodiment of the present invention. FIG. 7 is an exploded perspective view schematically illustrating the bandpass filter shown in FIG. 6. FIG. 8A is a plan view schematically illustrating a top surface of the bandpass filter shown in FIG. 6. FIG. 8B to 8D are plan views schematically illustrating interlayers of the bandpass filter shown in FIG. 6. FIG. 8E is a plan view schematically illustrating a bottom surface of the bandpass filter shown in FIG. 6. FIG. 8F is an enlarged plan view of FIG. 8C. FIG. 9 is a cross sectional view taken along the line IX-IX shown in FIG. 6. FIG. 10 is a cross sectional view taken along the line X-X shown in FIG. 6.

The following descriptions focus on only the differences from the embodiments shown in FIGS. 1 to 5, wherein the same reference numerals refer to the same constitutional elements, and therefore, the repetitive descriptions will be omitted.

In one embodiment, a bandpass filter 600 may comprise auxiliary resonant electrodes and/or auxiliary coupling electrodes. As shown in FIGS. 6 to 10, for example, the bandpass filter may comprise a first auxiliary input resonant electrode 31*a*, a second auxiliary input resonant electrode 31*c*, a first auxiliary output resonant electrode 31*b* and a second auxiliary output resonant electrode 31*d* on the dielectric layer 102 where the input coupling electrodes 40*a*, 40*c* and the output coupling electrodes 40*b*, 40*d* are located. In an embodiment, the auxiliary resonant electrodes 31*a*, 31*c*, 31*b*, and 31*d* can be arranged on the different dielectric layer from the dielectric layer 102 on which the coupling electrodes 40*a*, 40*b*, 40*c* and 40*d* are located.

Hereinafter, a group or the first auxiliary input resonant electrode 31*a* (first auxiliary resonant electrode), the second auxiliary input resonant electrode 31*c* (third auxiliary resonant electrode), the first auxiliary output resonant electrode 31*b* (second auxiliary resonant electrode) and the second auxiliary output resonant electrode 31*d* (fourth auxiliary resonant electrode) may be called as an auxiliary resonant electrodes 31*a*, 31*b*, 31*c* and 31*d*.

The input resonant electrode 30*a* comprises a first input contact point 72*a* near the right end 30*a*RE thereof and a second input point 72*c* near the left end 30*a*LE thereof, and the output resonant electrode 30*b* comprises a first output contact point 72*b* near the right end 30*b*RE thereof and a second output point 72*d* near the right end 30*b*LE thereof.

A first auxiliary input resonant electrode 31*a* comprises a third input contact point 73*a* which is connected to the first input contact point 72*a* of the input resonant electrode 30*a* via a penetration conductor 51*a* which penetrates the dielectric layer 102. A second auxiliary input resonant electrode 31*c* comprises a fourth input contact point 73*c* which is connected to the second input contact point 72*c* of the input resonant electrode 30*a* via a penetration conductor 51*c* which penetrates the dielectric layer 102.

A first auxiliary output resonant electrode 31*b* comprises a third output contact point 73*b* which is connected to the first output contact point 72*b* of the output resonant electrode 30*b* via a penetration conductor 51*b* which penetrates the dielectric layer 102. A second auxiliary output resonant electrode 31*d* comprises a fourth output contact point 73*d* which is connected to the second output contact point 72*d* of the output resonant electrode 30*d* via a penetration conductor 51*d* which penetrates the dielectric layer 102.

The auxiliary resonant electrodes 31*a*, 31*b*, 31*c* and 31*d* may have a desired shape such as a triangle, a square, and the like. The auxiliary resonant electrodes 31*a*, 31*b*, 31*c* and 31*d* can have, for example, "T" shapes as shown in FIGS. 7, 8C and 8F. In FIGS. 7, 8C and 8F, the first auxiliary input resonant electrode 31*a* comprises a first portion 311*a* which faces a part of the annular ground electrode 23, and a second portion 312*a* which comprises an open end 313*a*. The second portion 312*a* faces the first input coupling electrode 40*a* at the side of the first end 313*a*. The second portion 312*a* comprises the third input contact point 73*a* near the open end 313*a*.

In the same manner, the second auxiliary input resonant electrode 31*c* comprises a third portion 311*c* which faces a part of the annular ground electrode 23, and a fourth portion 312*c* which comprises an open end 313*c*. The fourth portion 312*c* faces the second input coupling electrode 40*c* at the side of the open end 313*c*. The third portion 312*c* comprises the fourth input contact point 73*c* near the open end 313*c*.

A first auxiliary output resonant electrode 31*b* comprises a fifth portion 311*b* which faces a part of the annular ground electrode 23, and a sixth portion 312*b* which comprises an second end 313*b*. The sixth portion 312*b* faces the first output coupling electrode 40*b* at the side of the third end 313*b*. The sixth portion 312*b* comprises the third output contact point 73*b* near the open end 313*b*.

The second auxiliary output resonant electrode 31*c* comprises a seventh portion 311*d* which faces a part of the annular ground electrode 23, and a eighth portion 312*d* which comprises an fourth end 313*d*. The eighth portion 312*d* faces the second output coupling electrode 40*d* at the side of the fourth end 313*b*. The eighth portion 312*c* comprises the fourth output contact point 73*d* near the open end 313*d*.

A bandpass filter 600 may comprise a third ground electrode 31*e* on the dielectric layer 102. The third ground electrode 31*e* can be located at the center of the upper surface of the dielectric layer 102. The auxiliary resonant electrodes 31*a*, 31*b*, 31*c* and 31*d* may be arranged symmetrical at the third ground electrode 31*e*. A part of the annular ground electrode 23 may face the first auxiliary output resonant electrode 31*b* at near the open end 30*c*E and the second auxiliary output resonant electrode 31*d* at near the open end 30*d*E. That is, the third ground electrode 31*e* is configured to be located such that the third ground electrode 31*e* faces each end of the first central resonant electrode 30*c* and the second central resonant electrode 30*d*, and therefore, the third ground electrode 31*e* is operable to be electromagnetically coupled to the first central resonant electrode 30*c* and the second central resonant electrode 30*d* equally. In such a case, the third ground electrode 31*e* may be located at a null point, and therefore have a ground potential.

Therefore, the third ground electrode 31*e* is not necessary to physically connect to a ground electrode as long as the third ground electrode 31*e* faces each end of the first central resonant electrode 30*c* and the second central resonant electrode 30*d*. This configuration is as effective as the configuration where the first auxiliary input resonant electrode 31*a*, the second auxiliary input resonant electrode 31*c*, the first auxiliary output resonant electrode 31*b*, and the second auxiliary output resonant electrode 31*d* face the annular ground electrode 23. According to an embodiment, the length of the resonant electrodes 30*a*, 30*b*, 30*c* and 30*d* can be shortened by adding the third ground electrode 31*e*.

Each of the auxiliary resonant electrodes 31*a*, 31*b*, 31*c* and 31*d* faces a facing area of the annular ground electrode 23. In the facing areas, capacitance is generated between the auxiliary resonant electrodes 31*a*, 31*b*, 31*c* and 31*d* and the annular ground electrode 23, and also between an area, which face the third ground electrode 31*e*, of the first central resonant electrode 30*c* near the one end thereof and an area, which face the third ground electrode 31*e*, of the second central resonant electrode 30*d* near the one end thereof, and the third ground electrode 31*e*. This configuration may shorten the length of the resonant electrodes 30*a*, 30*b*, and 30*c*, thus enabling a small-size bandpass filter.

Considering the dimensions and the capacitance, the facing area may be set, for example, to an area with about 0.01 to 0.3 $mm^2$. As the interval between the facing areas is smaller, a stronger coupling may be achieved, however, this makes it uneasy to manufacture the bandpass filter. Therefore, the interval is set, without limitation and for example, to about 0.05 to 0.5 mm.

The number and the arrangement of auxiliary resonant electrodes and ground electrodes are not limited to ones shown in FIGS. 6 to 10. For example, the bandpass filter 600 comprises two auxiliary resonant electrodes, the first auxiliary input resonant electrode 31*a* and the first auxiliary output resonant electrode 31*b*. That is, the second auxiliary input resonant electrode 31*c* and the second auxiliary output resonant electrode 31*d* can be omitted in an embodiment. Also, the bandpass filter 600 comprises the third ground electrode 31*e* which faces only the open end 30*c*E of the first central resonant electrode 30*c*. In this case, the third ground electrode 31*e* is not at a null point, and therefore the third ground electrode 31*e* is connected to a ground potential.

In an embodiment, a bandpass filter may comprise one or more auxiliary input coupling electrodes, and one or more auxiliary output coupling electrodes. Specifically, referring to FIGS. 6 to 10, the bandpass filter 600 further comprise a first auxiliary input coupling electrode 42*a* (or a first auxiliary coupling electrode), a second auxiliary input coupling electrode 42*c* (or a third auxiliary coupling electrode), a first auxiliary output coupling electrode 42*b* (or a second auxiliary coupling electrode), and a second auxiliary output coupling electrode 42*d* (or a fourth auxiliary coupling electrode) on the dielectric layer 103 which is one layer above the dielectric layer 103.

The first auxiliary input coupling electrode 42*a* comprises a first coupling contact point 74*a* and a first connecting point 75*a*. The first coupling contact point 74*a* is connected to the first input contact point 71*a* via a penetration conductor 52*a*, and the first connecting point 75*a* is connected to the first input terminal 60*a* via a penetration conductor 53*a*. A part of the first auxiliary input coupling electrode 42*a* is configured to face the first auxiliary input resonant electrode 31*a*.

The first auxiliary input coupling electrode 42*a* connected to the first input coupling electrode 40*a* and the first auxiliary input resonant electrodes 31*a* connected to the right half portion 301*a* of the input resonant electrode 30*a* are broadside coupled. In addition, a part of the first auxiliary input coupling electrode 42*a* faces the first auxiliary input resonant electrode 31*a* and is connected to the first input terminal electrode 60*a* at the first connecting point 75*a* via the penetration conductor 53*a*. That is, a differential signal inputted from an outside circuit is provided to the first input coupled electrode 40*a* via the first auxiliary input coupling electrode 42*a*.

Therefore, the coupling (first additional coupling) between the first auxiliary input coupling electrode 42*a* and the first auxiliary input resonant electrodes 31*a* is added to the coupling between the first input coupling electrode 40*a* and the right half portion 301*a* of the input resonant electrodes 30*a*, thereby making the overall coupling an inter-digital coupling. Therefore the overall coupling is strong.

Consequently, the coupling mentioned above can have a stronger coupling than that without the first additional coupling or that in a case in which the first auxiliary input coupling electrode 42*a* is connected to the first input terminal electrode 60*a* at the first coupling contact point 74*a* instead of the first connecting point 75*a*.

The second auxiliary input coupling electrode 42*c* comprises a second coupling contact point 74*c* and a second connecting point 75*c*. The second coupling contact point 74*c* is connected to the second input contact point 71*c* via a penetration conductor 52*c*, and the second connecting point 75*c* is connected to the second input terminal 60*c* via a penetration conductor 53*c*. A part of the second auxiliary input coupling electrode 42*c* is configured to face the second auxiliary input resonant electrode 31*c*.

The second auxiliary input coupling electrode 42*c* connected to the second input coupling electrode 40*c* and the second auxiliary input resonant electrode 31*c* connected to the right half portion 302*a* of the input resonant electrode 30*a* are broad-side coupled. In addition, a part of the second auxiliary input coupling electrode 42*c* faces the second auxiliary input resonant electrode 31*c* and is connected to the first input terminal electrode 60*c* at the second connecting point 75*c* via the penetration conductor 53*c*. That is, a differential signal inputted from an outside circuit is provided to the second input coupled electrode 40*c* via the second auxiliary input coupling electrode 42*c*.

Therefore, the coupling (second additional coupling) between the second auxiliary input coupling electrode 42*c* and the first auxiliary input resonant electrodes 31*a* is added to the coupling between the second input coupling electrode 40*c* and the left half portion 302*a* of the input resonant electrodes 30*a*, thereby making the overall coupling an inter-digital coupling. Therefore the overall coupling is strong.

Consequently, the coupling mentioned above can have a stronger coupling than that without the second additional coupling or that in a case in which the second auxiliary input coupling electrode 42*c* is connected to the second input terminal electrode 60*c* the second coupling contact point 74*c* instead of the second connecting point 75*c*.

The first auxiliary output coupling electrode 42*b* comprises a third coupling contact point 74*b*. The third coupling contact point 74*b* is connected to the first output contact point 71*b* via a penetration conductor 52*b*. A part of the first auxiliary output coupling electrode 42*b* faces the first auxiliary output resonant electrode 31*c*. The first auxiliary output coupling electrode 42*b* may not be electrically connected to the output terminal electrode 60*b*. Instead, the output terminal electrode 60*b* is electrically connected to the output connecting electrode 70*b* which is electrically connected to the first auxiliary output resonant electrode 31*b*. An unbalanced type electrical signal is outputting to an outside circuit from the first auxiliary output resonant electrode 31*b* via the output terminal electrode 60*b*.

The first auxiliary output coupling electrode 42*b* connected to the first output coupling electrode 40*b* and the first auxiliary output resonant electrodes 31*b* connected to the right half portion 301*b* of the output resonant electrode 30*b* are broad-side coupled.

Therefore, the coupling (third additional coupling) between the first auxiliary output coupling electrode 42*b* and the first auxiliary output resonant electrodes 31*b* is added to the coupling between the first output coupling electrode 40*b* and the right half portion 301*b* of the output resonant electrodes 30*b*, thereby making the overall coupling an inter-digital coupling. Therefore the overall coupling is strong.

Consequently, the coupling mentioned above can have a stronger coupling than that without the first additional coupling or that in a case in which the first auxiliary output coupling electrode 42*b* is connected to the output terminal electrode 60*b* at the third coupling contact point 74*a* instead of the third connecting point 75*a*.

The second auxiliary output coupling electrode 42*d* comprises a fourth coupling contact point 74*d* and a fourth connecting point 75*a*. The fourth coupling contact point 74*d* is connected to the second output contact point 71*d* via a penetration conductor 52*d*, and the fourth connecting point 75*d* is connected to the second output terminal 60*d* via a penetration conductor 53*d*. A part of the second auxiliary output coupling electrode 42*d* is configured to face the first auxiliary output resonant electrode 31*d*.

The second auxiliary output coupling electrode 42*d* connected to the second output coupling electrode 40*d* and the second auxiliary output resonant electrodes 31*d* connected to the left half portion 302*b* of the output resonant electrode 30*b* are broad-side coupled.

Therefore, the coupling (fourth additional coupling) between the second auxiliary output coupling electrode 42*d* and the second auxiliary output resonant electrodes 31*d* is added to the coupling between the second output coupling electrode 40*d* and the left half portion 302*b* of the output resonant electrodes 30*b*, thereby making the overall coupling an inter-digital coupling. Therefore the overall coupling is strong.

Consequently, the coupling mentioned above can have a stronger coupling than that without the fourth additional coupling.

The bandpass filter 600 with such a structure can reduce an increase of insertion loss at frequencies between resonance frequencies of resonance mode even in the broad pass band, and has a flat and low-loss transmission characteristic over the entire region of the broad pass band.

In an embodiment, the widths of the auxiliary input coupling electrode 42*a*, 42*c* and auxiliary output coupling electrodes 42*b*, 42*d* may be set, without limitation, to be substantially the same as those of the input coupling electrodes 40*a*, 40*c* and the output coupling electrodes 40*b*, 40*d*, respectively. The lengths of the auxiliary input coupling electrode 42*a*, 42*c* and auxiliary output coupling electrodes 42*b*, 42*d* may be set, without limitation, to be substantially the same as those of the input auxiliary resonant electrodes 31*a*, 31*c* and the output auxiliary resonant electrodes 31*b*, 31*d*, respectively. As the dielectric layer 103 which is equal to the distance between the auxiliary coupling electrodes 42*a*, 42*b*, 42*c*, 42*d* and the auxiliary resonant electrodes 31*a*, 31*b*, 30*c*, 31*d* is thinner, each coupling may become stronger but they may become difficult to be manufactured. Therefore, the thickness of the dielectric layer 103 (i.e. the distance between the auxiliary coupling electrodes and the auxiliary resonant electrodes) is set, without limitation, to about 0.01 to 0.5 mm.

According to an embodiment of the present invention, one or more additional auxiliary resonant electrodes (not shown) may be added to the auxiliary resonant electrodes 31*a*, 31*b*,

30*c* and 31*d* in another dielectric layer. For example, the additional auxiliary resonant electrodes may be located on a dielectric layer (not shown) which is under the dielectric layer 101 on which the resonant electrodes 30*a*, 30*b*, 30*c* and 30*d* are located.

In addition, the additional auxiliary resonant electrodes may be electrically connected to the first central resonant electrode 30*c* or the second central resonant electrode 30*d* via penetration conductors. This configuration can make the capacitance bigger if the size of the resonant electrodes 30*a*, 30*b*, 30*c* and 30*d* is same, and make the size of the resonant electrodes 30*a*, 30*b*, 30*c* and 30*d* smaller if the capacitance is same.

Furthermore, the bandpass filter 600 may comprise one or more additional couplings added to the couplings between the coupling electrodes 40*a*, 40*b*, 40*c* and 40*d* and the resonant electrodes 30*a* and 30*b*, and between the auxiliary input coupling electrodes 42*a*, 42*b*, 42*c* and 42*d* and the auxiliary input resonant electrode 31*a*, 31*b*, 31*c* and 31*d*. The additional electrode for additional couplings may be located in any inter-layer(s).

In the same manner, the bandpass filter 600 may comprise another pair of electrode for output and the additional coupling can be added to the coupling between the first output coupling electrode 40*b* and the output resonant electrode 30*b*, and between the first auxiliary output coupling electrode 42*b* and the first auxiliary output resonant electrode 31*b* (or between the second output coupling electrode 40*d* and the output resonant electrode 30*b*, and between the second auxiliary output coupling electrode 42*d* and the second auxiliary output resonant electrode 31*d*).

Figure 11:
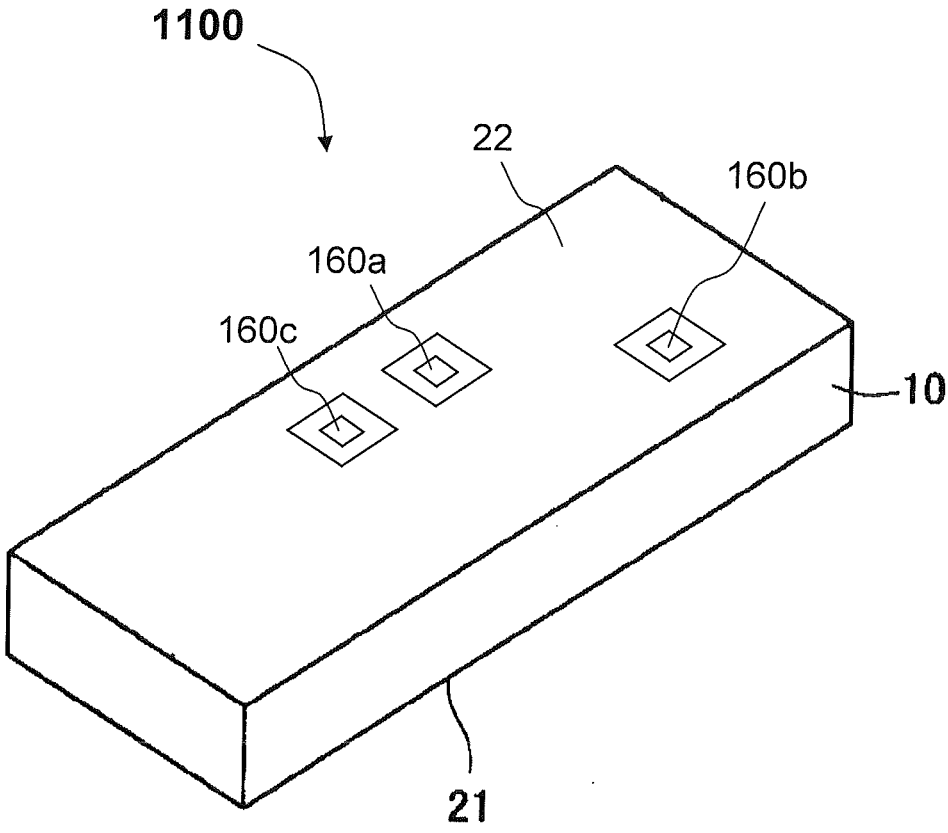
FIG. 11 is a perspective view schematically illustrating the external appearance of a bandpass filter according to one embodiment of the present invention.
Figure 12:
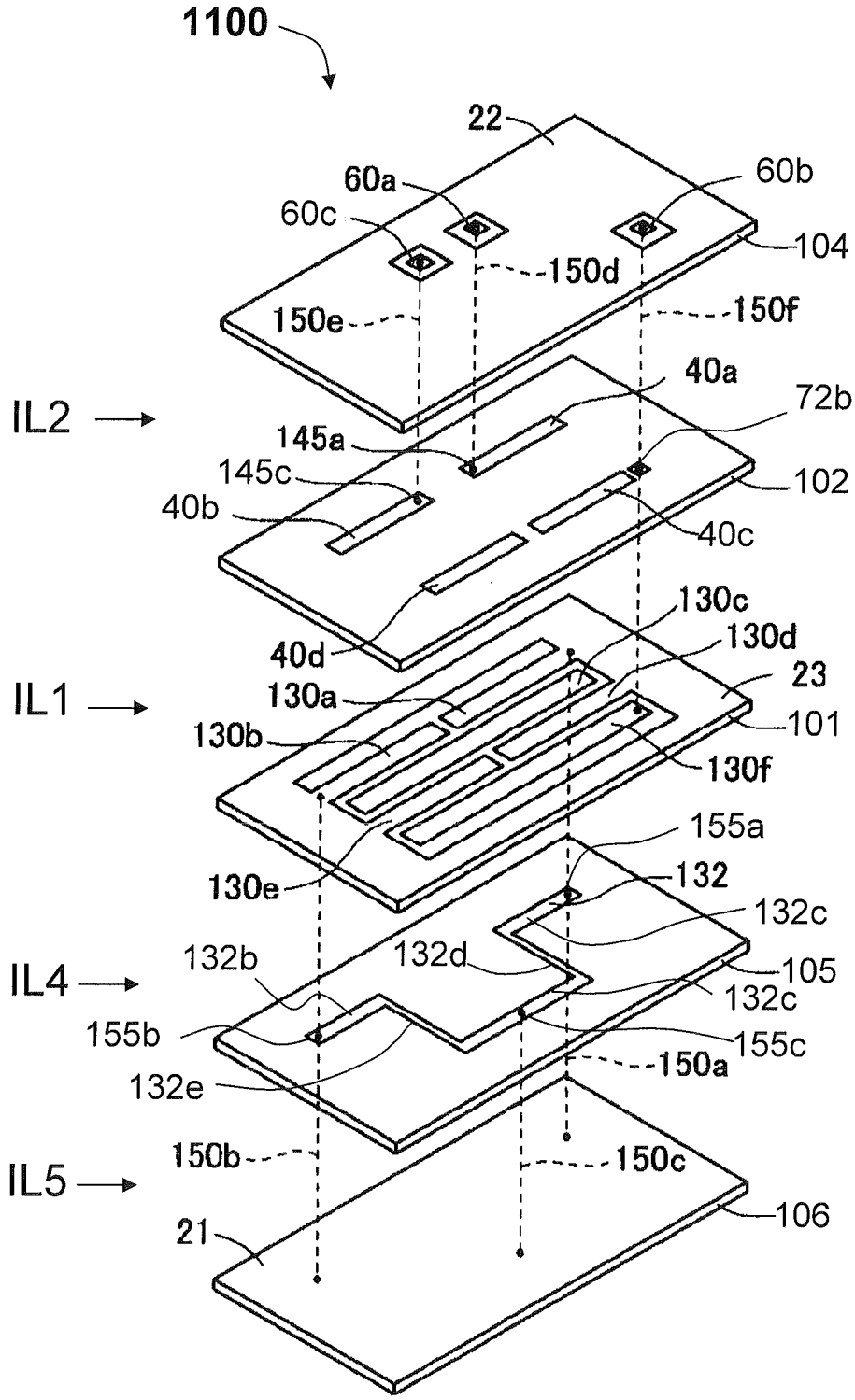
FIG. 12 is an exploded perspective view schematically illustrating the bandpass filter shown in FIG. 11.

FIG. 11 is a perspective view schematically illustrating the external appearance of a bandpass filter 1100 according to one embodiment of the present invention. FIG. 12 is an exploded perspective view schematically illustrating the bandpass filter 1100 shown in FIG. 11.

The following descriptions focus on the differences from the embodiments shown in FIGS. 1 to 5 or 6 to 10, wherein the same reference numerals refer to the same constitutional elements, and therefore, the repetitive descriptions will be omitted.

A bandpass filter 1100 comprises a laminated body 10. The laminate 10 comprises dielectric layers 101, 102, 104, 105 and 106. The bandpass filter 1100 further comprises a first ground electrode 21, a second ground electrode 22. In FIG. 12, the first ground electrode 21 is illustrated as a layer on the upper surface of the dielectric layer 106 or is in a fifth inter-layer IL5 between the dielectric layers 105 and 106. The second ground electrode 22 is located on an upper surface of the dielectric layer 104.

A bandpass filter 1100 may comprise a first input terminal electrode 60*a*, an output terminal electrode 60*b*, and a second input terminal electrode 60*c*. Compared to the embodiments showed in FIGS. 1 to 10, the first input terminal electrode 60*a* and the output terminal electrode 60*b* are differently arranged. That is, the first input terminal electrode 60*a* and the output terminal electrode 60*b* are located near the center of the upper surface of the dielectric layer 104.

The bandpass filter 1100 further comprises a first ¼ wavelength resonant electrode 130*a*, a second ¼ wavelength resonant electrode 130*b*, a first ½ wavelength resonant electrode 130*c*, a third ¼ wavelength resonant electrode 130*d*, a fourth ¼ wavelength resonant electrode 130*e*, and a second ½ wavelength resonant electrode 130*f*. The first ¼ wavelength resonant electrode 130*a*, the second ¼ wavelength resonant electrode 130*b*, the first ½ wavelength resonant electrode 130*c*, the third ¼ wavelength resonant electrode 130*d*, the fourth ¼ wavelength resonant electrode 130*e*, and the second ½ wavelength resonant electrode 130*f* may be referred to resonant electrodes 130*a*, 130*b*, 130*c*, 130*d*, 130*e*, and 130*f*. The resonant electrodes 130*a*, 130*b*, 130*c*, 130*d*, 130*e*, and 130*f* are located on the dielectric layer 101.

Compared to the resonant electrodes 30*a*, 30*b*, 30*c* and 30*d* shown in FIGS. 1 to 10, two ¼ wavelength resonant electrode are added to the resonant electrodes 30*a*, 30*b*, 30*c* and 30*d*, which are respectively corresponding to the resonant electrodes 130*c*, 30*f*, 30*d* and 30*e*, to make the resonant electrodes 130*a*, 130*b*, 130*c*, 130*d*, 130*e*, and 130*f*. In other words, two ¼ wavelength resonant electrode 130*a* and 130*b* are added next of the input resonant electrodes 30*a* (i.e., the first ½ wavelength resonant electrode 130*c*).

In the embodiment shown FIGS. 1 to 10, the input resonant electrode 30*a* is uses as an input/output resonant electrode. In contrast, the first ¼ wavelength resonant electrode 130*a* and the second ¼ wavelength resonant electrode 130*b* may be used as an input/output resonant electrode. Consequently, a differential signal can be input to the first and second ¼ wavelength resonant electrode 130*a* and 130*b*. As described in the above embodiments, the second ½ wavelength resonant 130*f* may be used as an input/output resonant electrode.

The first ¼ wavelength resonant electrode 130*a* comprises an open end and the ground end. The ground end is connected to the annular ground electrode 23. In the same manner, the second wavelength resonant electrode 130*b* comprises an open end and the ground end. The ground end is connected to the annular ground electrode 23. The open ends of the first ¼ wavelength resonant electrode 130*a* and the second wavelength resonant electrode 130*b* are separated but are close, and the sides of the open ends of the first ¼ wavelength resonant electrode 130*a* and the second wavelength resonant electrode 130*b* face each other.

The first ¼ wavelength resonant electrode 130*a* is disposed such that the electromagnetic coupling is mutually generated between the first ¼ wavelength resonant electrode 130*a* and the first ½ wavelength resonant electrode 130*c*. The first ¼ wavelength resonant electrode 130*a* is located across the right half portion of the first ½ wavelength resonant electrode 130*c* from the third ¼ wavelength resonant electrode 130*d*. That is, the right half portion of the first ½ wavelength resonant electrode 130*c* is sandwiched by the first ¼ wavelength resonant electrode 130*a* and the third ¼ wavelength resonant electrode 130*d*. The first ¼ wavelength resonant electrode 130*a* faces the right half portion of the first ½ wavelength resonant electrode 130*c*.

The second ¼ wavelength resonant electrode 130*b* is disposed such that the electromagnetic coupling is mutually generated between the second ¼ wavelength resonant electrode 130*b* and the first ½ wavelength resonant electrode 130*c*. The second ¼ wavelength resonant electrode 130*b* is located across the first ½ wavelength resonant electrode 130*c* from the fourth ¼ wavelength resonant electrode 130*e*. That is, the left half portion of the first ½ wavelength resonant electrode 130*c* is sandwiched by the second ¼ wavelength resonant electrode 130*b* and the fourth ¼ wavelength resonant electrode 130*e*. The second ¼ wavelength resonant electrode 130*b* faces the left half portion of the first 130*c*.

The bandpass filter 1100 further comprises a first coupling electrode 40*a* (or first input coupling electrode), a third coupling electrode 40*c* (or first output coupling electrode), a second coupling electrode 40*b* (or second input coupling electrode) and a fourth coupling electrode 40*d* (or second output coupling electrode) in the second inter-layer IL2. The coupling electrodes 40*a*, 40*b*, 40*c* and 40*d* are located on the dielectric layer 102 same as those shown in FIGS. 1 to 5.

The first coupling electrode 40*a* comprise a first input/output point 145*a*, which is located near an open end, close to the second coupling electrode 40*b*, so as to face the open end side from the center of the first ¼ wavelength resonant electrode 130*a*. Similarly, the second coupling electrode 40*b* comprise a second input/output point 145*c*, which is located near an open end, close to the first coupling electrode 40*a*, so as to face the open end side from the center of the second ¼ wavelength resonant electrode 130*b*.

The first coupling electrode 40*a* faces the first ¼ wavelength resonant electrode 130*a*, and therefore, the electromagnetic coupling is generated between the first coupling electrode 40*a* and the first ¼ wavelength resonant electrode 130*a*. In the same manner, the second coupling electrode 40*b* faces the second ¼ wavelength resonant electrode 130*b*, and therefore, the electromagnetic coupling is generated between the third coupling electrode 40*c* and the second ¼ wavelength resonant electrode 130*b*.

The third coupling electrode 40*c* faces the right half portion of the second ½ wavelength resonant electrode 130*f*, and therefore, the electromagnetic coupling is generated between the third coupling electrode 40*c* and the second ¼ wavelength resonant electrode 130*f*. In the same manner, the fourth coupling electrode 40*d* faces the left half portion of the second ½ wavelength resonant electrode 130*f*, and therefore the electromagnetic coupling is generated between the fourth coupling electrode 40*d* and the second ½ wavelength resonant electrode 130*f*.

The bandpass filter 1100 further comprises a resonant electrode coupling conductor 132. The resonant electrode coupling conductor 132 is located on the dielectric layer 105. In other words, the resonant electrode coupling conductor 132 is disposed in a fourth inter-layer IL4 that is located below the first inter-layer IL1. The resonant electrode coupling conductor 132 comprises a first portion 132*a*, a second portion 132*b*, a third portion 132*c* and connecting portions 132*d* and 132*e*.

In the resonant electrode coupling conductor 132, the first portion 132*a* comprises an open end and a connection end which is connected to the connecting portion 132*d*. The first portion 132*a* further comprises a first grounding point 155*a* near the open end thereof. In the same manner, the second portion 132*b* comprises an open end and a connection end which is connected to the connecting portion 132*e*. The second portion 132*b* further comprises a second grounding point 155*b* near the open end thereof. The third portion 132*c* comprises two connecting ends and a third grounding point 155*c* near the center thereof. The two connecting ends are connected to the connecting portion 132*d* or the connecting portion 132*e*.

The first portion 132*a* faces the ground end side of the first ¼ wavelength resonant electrode 130*a*, and therefore, the electromagnetic coupling is generated between the first portion 132*a* and the first ¼ wavelength resonant electrode 130*a*. In the same manner, the second portion 132*b* faces the ground end side of the second ¼ wavelength resonant electrode 130*b*, and therefore, the electromagnetic coupling is generated between the second portion 132*b* and the second ¼ wavelength resonant electrode 130*b*.

The third portion 132*c* faces the center portion of the second ½ wavelength, and therefore, the electromagnetic coupling is generated between the first portion 132*a* and the first ¼ wavelength resonant electrode 130*a*.

An annular ground electrode 23 surrounds not only the first ½ wavelength resonant electrode 130*c*, the third ¼ wavelength resonant electrode 130*d*, the fourth ¼ wavelength resonant electrode 130*e* and the second ½ wavelength resonant electrode 130*f*, but also, the first ¼ wavelength resonant electrode 130*a* and the second ¼ wavelength resonant electrode 130*b*. Therefore, the annular ground electrode 23 is connected to ground terminals of the ¼ wavelength resonant electrodes 130*a*, 130*b*, 130*d*, and 130*e*.

The first grounding point 155*a* of the first portion 132*a* is connected to the first ground electrode 21 and the annular ground electrode 123 through a penetration conductor 150*a*. Similarly, the second grounding point 155*b* of the second portion 132*b* is connected to the first ground electrode 21 and the annular ground electrode 123 through a penetration conductor 150*b*. The third portion 132*c* of the resonant electrode coupling conductor 132 is electrically connected to the first ground 21 via a penetration conductor 150*c*. The first output contact point 72*b* is connected to the output terminal electrode 60*b* and the second ½ wavelength resonant electrode 130*f* through a penetration conductor 150*f*.

The first input/output point 145*a* is connected to the first coupling electrode 40*a* via a penetration conductor 150*d*, and one of differential signals is fed into or supplied from the first input/output point 145*a*. The second input/output point 145*c* is connected to the second coupling electrode 40*b* via a penetration conductor 150*d*, and the other of the differential signals is fed into or supplied from the second input/output point 145*c*.

The electromagnetic coupling is generated between the first ¼ wavelength resonant electrode 130*a* and the first ½ wavelength resonant electrode 130*c*, and between the second ¼ wavelength resonant electrode 130*b* and the first ½ wavelength resonant electrode 130*c* in an inter-digital manner. The electromagnetic coupling is generated between the first ½ wavelength resonant electrode 130*c* and the third ¼ wavelength resonant electrode 130*d*, and between first ½ wavelength resonant electrode 130*c* and the fourth ¼ wavelength resonant electrode 130*e* in the inter-digital manner. The electromagnetic coupling is generated between the third ¼ wavelength resonant electrode 130*d* and the second ½ wavelength resonant electrode 130*f*, and between the fourth ¼ wavelength resonant electrode 130*e* and the second ½ wavelength resonant electrode 130*f* in the inter-digital manner. Accordingly, the electromagnetic coupling is generated in all the adjacent resonant electrodes in the inter-digital manner. The coupling by the electric field and the coupling by the magnetic field are added to generate the coupling stronger than that of comb-line type coupling. Therefore, a frequency interval between resonant frequencies in each resonant mode can properly be set to obtain a largely wide passband width having a fractional bandwidth of about 40%. The passband width having the fractional bandwidth of about 40% far exceeds the region that can be realized with the filter in which the conventional ¼ wavelength resonator is used.

The first coupling electrode 40*a* is broad-side coupled with the first ¼ wavelength resonant electrode 130*a* in the inter-digital manner. Second coupling electrode 40*b* is broad-side coupled with the second ¼ wavelength resonant electrode 130*b* in the inter-digital manner. Each of the third coupling electrode 40*c* and the fourth coupling electrode 40*d* is broad-side coupled with the second ½ wavelength resonant electrode 130*f* in the inter-digital manner. The broad-side coupling is stronger than the edge coupling. Further, because the coupling is the inter-digital manner, as with the above-described coupling between the resonant electrodes, the coupling by the magnetic field and the coupling by the electric field are added to generate the strong coupling. Therefore, the significantly strong coupling is generated between the first coupling electrode 40*a* and the first ¼ wavelength resonant electrode 130*a*, between the third coupling electrode 40*c* and the second ¼ wavelength resonant electrode 130*b*, between the third coupling electrode 40*c* and the second ½ wavelength resonant electrode 130*f*, and between the fourth coupling electrode 40*d* and the second ½ wavelength resonant electrode 130*f*, which allows the novel bandpass filter to be obtained. In existing bandpass filters, even in the passband that far exceeds the region that can be realized with the filter in which the conventional ¼ wavelength resonator is used, the insertion loss is not largely increased in the frequency located between the resonant frequency in each resonant mode, the insertion loss becomes flat in the whole region of the passband, and the low-loss bandpass characteristic can be obtained.

The structure illustrated in FIG. 12 is equivalent to have two filter circuits, a first circuit and a second circuit, that are connected in parallel. The first filter circuit comprises the first ¼ wavelength resonant electrode 130*a*, the right half portion of the first ½ wavelength resonant electrode 130*c*, and the third ¼ wavelength resonant electrode 130*d* and the right half portion of the second ½ wavelength resonant electrode 130*f*. The second filter circuit comprises the second ¼ wavelength resonant electrode 130*b*, the left half portion of the first ½ wavelength resonant electrode 130*c*, and the fourth ¼ wavelength resonant electrode 130*e* and the left half portion of the second ½ wavelength resonant electrode 130*f*.

In each filter circuit, inductive coupling is generated by the resonant electrode coupling conductor 132 between the first-stage resonant electrode and the last-stage resonant electrode. In each filter circuit, the adjacent resonant electrodes are coupled in the inter-digital manner, and the coupling by the magnetic field and the coupling by the electric field are added to generate the strong coupling. However, in the filter circuit, capacitive coupling is generated as a whole. Therefore, a phase difference of 1800 is generated between a signal that is transmitted by the inductive coupling between the first-stage resonant electrode and the last-stage resonant electrode of the filter circuit including the four-stage resonant electrode through the resonant electrode coupling conductor 132 and a signal that is transmitted by the capacitive coupling between the adjacent resonant electrodes, so that a phenomenon in which the signals are cancelled each other can be generated. Because the phenomenon can be generated near both sides of the passband of the bandpass filter, an attenuation pole in which the signal is hardly transmitted can be formed near both sides of the passband in the bandpass characteristic of the bandpass filter.

The ground terminals of the first ¼ wavelength resonant electrode 130*a*, second ¼ wavelength resonant electrode 130*b*, the third ¼ wavelength resonant electrode 130*d*, and the fourth ¼ wavelength resonant electrode 130*e* can easily be grounded by connecting the ground terminals to the annular ground electrode 123. By electromagnetically shielding the surround of each resonant electrode, an influence of an external electromagnetic noise can be reduced while a leakage of an electromagnetic wave generated from each resonant electrode to the surround can be reduced. The effect is particularly useful to prevent the adverse effect to other regions of the module board when the bandpass filter is formed in part of the region of the module board.

In one embodiment, a bandpass filter may have two or more resonance coupling electrodes.

Figure 13:
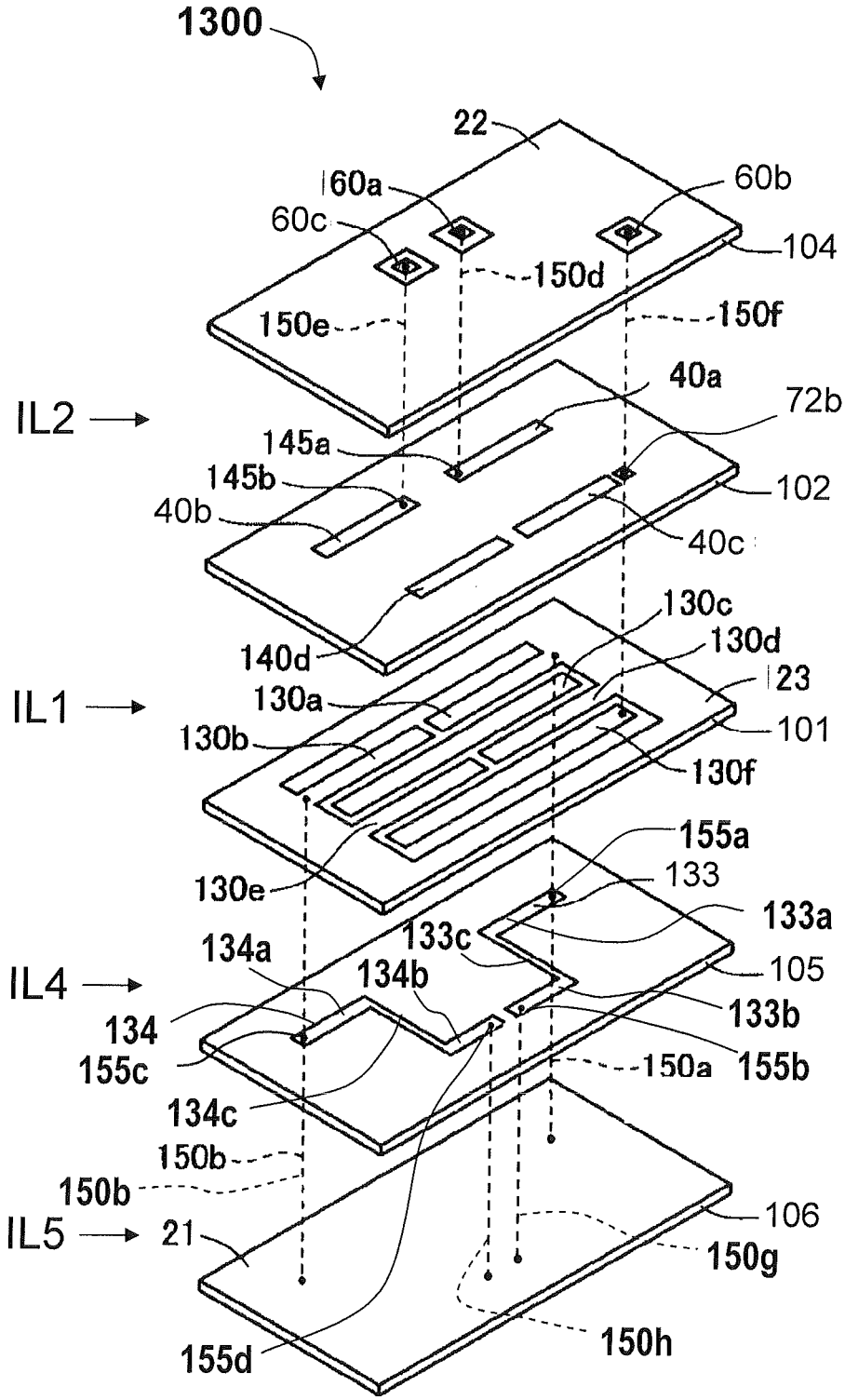
FIG. 13 is an exploded perspective view schematically illustrating the bandpass filter according to one embodiment of the present invention.

FIG. 13 is an exploded perspective view schematically illustrating a bandpass filter 1300 according to one embodiment of the present invention. The following descriptions focus on the differences from the embodiment shown in FIGS. 11 and 12, wherein the same reference numerals refer to the same constitutional elements, and therefore, the repetitive descriptions will be omitted.

The bandpass filter 1300 comprises two resonance coupling electrodes, a first resonance coupling electrode 133 and a second resonance coupling electrode 134 instead of one resonance coupling electrode shown in FIG. 12. In other words, the resonance coupling electrode comprises two pieces of sub resonance coupling electrodes (i.e., resonant electrode coupling conductors 133 and 134). The resonant electrode coupling conductors 133 and 134 are disposed on the dielectric layer 105.

The first resonance coupling electrode 133 comprises a first portion 133*a*, a second portion 133*b* and a third portion 133*c*. The third portion 133*c* electrically connects the first portion 133*a* with the second portion 133*b*. The first portion 133*a* comprises a first end. The first portion 133*a* also comprises a first connection point 155*a* near the first end. The second portion 133*b* comprises a second end. The second portion 133*b* also comprises a second connection point 155*b* near the second end.

The second resonance coupling electrode 134 comprises a fourth portion 134*a*, a fifth portion 134*b* and a sixth portion 134*c*. The fourth portion 134*a* comprises a third end. The fourth portion 133*a* also comprises a third connection point 155*c* near the third end. The fifth portion 134*b* comprises a fourth end. The fifth portion 134*b* also comprises a fourth connection point 155*d* near the fourth end. The third portion 134*c* electrically connects the first portion 134*a* with the second portion 134*b*.

The first connection point 155*a* and the third connection point 155*c* are electrically connected to the first ground 21 via a penetration conductor 150*a* and 150*c*, respectively. The second connection point 155*b* and the fourth connection point 155*d* are electrically connected to the first ground 21 via a penetration conductor 150*g* and 150*h*, respectively.

The first part 133*a* faces the first ¼ wavelength resonant electrode 130*a* such that the electromagnetic coupling is generated between the first part 133*a* and the first ¼ wavelength resonant electrode 130*a*. The second portion 133*b* faces the center area of the right half portion of the second ½ wavelength resonant electrode 130*f* such that the electromagnetic coupling is generated between the second portion 133*b* and the second ½ wavelength resonant electrode 130*f*.

The fourth part 134*a* faces the second ¼ wavelength resonant electrode 130*b* such that the electromagnetic coupling is generated between the fourth part 134*a* and the second ¼ wavelength resonant electrode 130*b*. The fifth portion 134*b* faces the center area of the right half portion of the second ½ wavelength resonant electrode 130*f* such that the electromagnetic coupling is generated between the fourth part 134*a* and the second ½ wavelength resonant electrode 130*f*.

Figure 14:
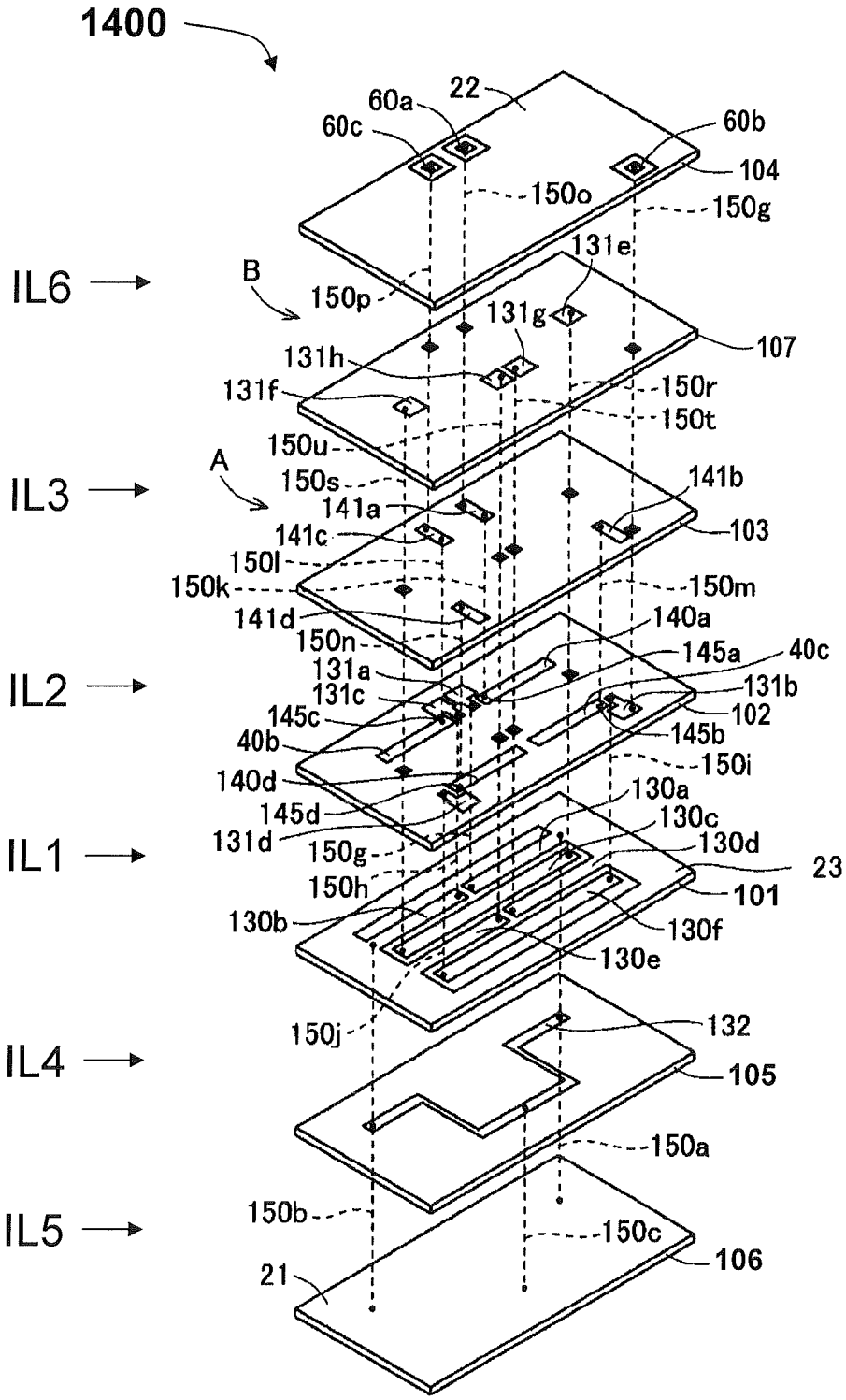
FIG. 14 is an exploded perspective view schematically illustrating the bandpass filter according to one embodiment of the present invention.

FIG. 14 is an exploded perspective view schematically illustrating a bandpass filter 1400 according to an embodiment of the present invention. The following descriptions focus on only the differences from the embodiment shown in FIG. 12, wherein the same reference numerals refer to the same constitutional elements, and therefore, the repetitive descriptions will be omitted.

In a bandpass filter 1400 of FIG. 14, a first auxiliary resonant electrode 131*a* that is connected to the open end side of the first ¼ wavelength resonant electrode 130*a* by a penetration conductor 150*g*, a second auxiliary resonant electrode 131*b* that is connected to the open end side of the second ¼ wavelength resonant electrode 130*b* by a penetration conductor 150*h*, a third auxiliary resonant electrode 131*c* that is connected to one end side in the one-end-side region of the second ½ wavelength resonant electrode 130*f* by a penetration conductor 150*i*, and a fourth auxiliary resonant electrode 131*d* that is connected to the other end side in the-other-end-side region of the second ½ wavelength resonant electrode 130*f* by a penetration conductor 150*j* are disposed in the second inter-layer IL2 of the laminate. The first auxiliary resonant electrode 131*a*, the second auxiliary resonant electrode 131*b*, the third auxiliary resonant electrode 131*c*, and the fourth auxiliary resonant electrode 131*d* are disposed so as to have the regions facing the annular ground electrode 123, respectively.

The bandpass filter 1400 of FIG. 14 comprises a first auxiliary coupling electrode 141*a*, a second auxiliary coupling electrode 141*b*, a third auxiliary coupling electrode 141*c*, and a fourth auxiliary coupling electrode 141*d* in a third inter-layer IL3 that is located across the second inter-layer IL2 from the first inter-layer IL1. The first auxiliary coupling electrode 141*a* is connected to the first input/output point 145*a* of the first coupling electrode 40*a* by a penetration conductor 150*k*, and is disposed so as to have a region facing the first auxiliary resonant electrode 131*a*. The second auxiliary coupling electrode 141*b* is connected to the second input/output point 145*c* of the second coupling electrode 40*b* by a penetration conductor 150*l*, and is disposed so as to have a region facing the second auxiliary resonant electrode 131*b*. The third auxiliary coupling electrode 141*c* is connected to the third input/output point 145*c* of the third coupling electrode 40*c* by a penetration conductor 150*m*, and is disposed so as to have a region facing the third auxiliary resonant electrode 131*c*. The fourth auxiliary coupling electrode 141*d* is connected to the fourth input/output point 145*d* of the fourth coupling electrode 40*d* by a penetration conductor 150*n*, and is disposed so as to have a region facing the fourth auxiliary resonant electrode 131*d*.

A first input/output terminal electrode 60*a* and a second input/output terminal electrode 60*b* are connected to the first auxiliary coupling electrode 141*a* and the second auxiliary coupling electrode 141*b* through penetration conductors 150*o* and 150*p*, respectively. A second terminal electrode 60*c* and a fourth input/output terminal electrode 60*d* are connected to the third auxiliary coupling electrode 141*c* and the fourth auxiliary coupling electrode 141*d* through penetration conductors 150*q* and 150*r*, respectively. The differential signals are fed and supplied between the first coupling electrode 40*a* and second coupling electrode 40*b* and an external circuit through the first input/output terminal electrode 60*a* and second input/output terminal electrode 60*b*, the first auxiliary coupling electrode 141*a* and second auxiliary coupling electrode 141*b*, and the penetration conductors 150*o* and 150*p*. The differential signals are fed and supplied between the third coupling electrode 40*c* and fourth coupling electrode 40*d* and the external circuit through the third input/output terminal electrode 60*c* and fourth input/output terminal electrode 60*d*, and the third auxiliary coupling electrode 141*c* and fourth auxiliary coupling electrode 141*d*, and the penetration conductors 150*q* and 150*r*, thereby acting as a bandpass filter in which the differential input/output can be performed.

The bandpass filter 1400 further comprises an auxiliary resonant electrode 131*e*, an auxiliary resonant electrode 131*f*, an auxiliary resonant electrode 131*g*, and an auxiliary resonant electrode 131*h* in a fifth inter-layer IL25 located between the first inter-layer IL1 of the laminate and the upper surface of the laminate so as to face the second ground electrode 22. The auxiliary resonant electrode 131*e* and the auxiliary resonant electrode 131*f* are connected to one end side and the other end side of the first ½ wavelength resonant electrode 130*c* by penetration conductors 150*s* and 150*t*, respectively. The auxiliary resonant electrode 131*g* and the auxiliary resonant electrode 131*h* are connected to the open end sides of the third ¼ wavelength resonant electrode 130*d* and the fourth ¼ wavelength resonant electrode 130*e* by penetration conductors 150*u* and 150*v*, respectively.

The coupling by the electromagnetic between the first auxiliary coupling electrode 141*a* and second auxiliary coupling electrode 141*b* and the first auxiliary resonant electrode 131*a* and second auxiliary resonant electrode 131*b* is added to the coupling by the electromagnetic between the first coupling electrode 40*a* and second coupling electrode 40*b* and the first ¼ wavelength resonant electrode 130*a* and second ¼ wavelength resonant electrode 130*b*.

The coupling by the electromagnetic between the third auxiliary coupling electrode 141*c* and fourth auxiliary coupling electrode 141*d* and the third auxiliary resonant electrode 131*c* and fourth auxiliary resonant electrode 131*d* is added to the coupling by the electromagnetic between the third coupling electrode 40*c* and fourth coupling electrode 40*d* and the one-end-side region and the-other-end-side region of the second ½ wavelength resonant electrode 130*f*.

Therefore, the coupling by the electromagnetic between the first coupling electrode 40*a* and second coupling electrode 40*b* and the first ¼ wavelength resonant electrode 130*a* and a second ¼ wavelength resonant electrode 130*b* and the coupling by the electromagnetic between the third coupling electrode 40*c* and fourth coupling electrode 40*d* and the one-end-side region and the-other-end-side region of the second ½ wavelength resonant electrode 130*f* are further strengthened.

The first auxiliary resonant electrode 131*a*, the second auxiliary resonant electrode 131*b*, the third auxiliary resonant electrode 131*c*, and the fourth auxiliary resonant electrode 131*d* are disposed so as to have the regions facing the annular ground electrode 123, respectively. The auxiliary resonant electrode 131*e*, the auxiliary resonant electrode 131*f*, the auxiliary resonant electrode 131*g*, and the auxiliary resonant electrode 131*h* are disposed so as to have the regions facing the second ground electrode 22. A length of the resonant electrode connected to each auxiliary resonant electrode is shortened by an electrostatic capacitance generated between each auxiliary resonant electrode and the annular ground electrode 23 or second ground electrode 22, so that the compact bandpass filter can be obtained.

Figure 15:
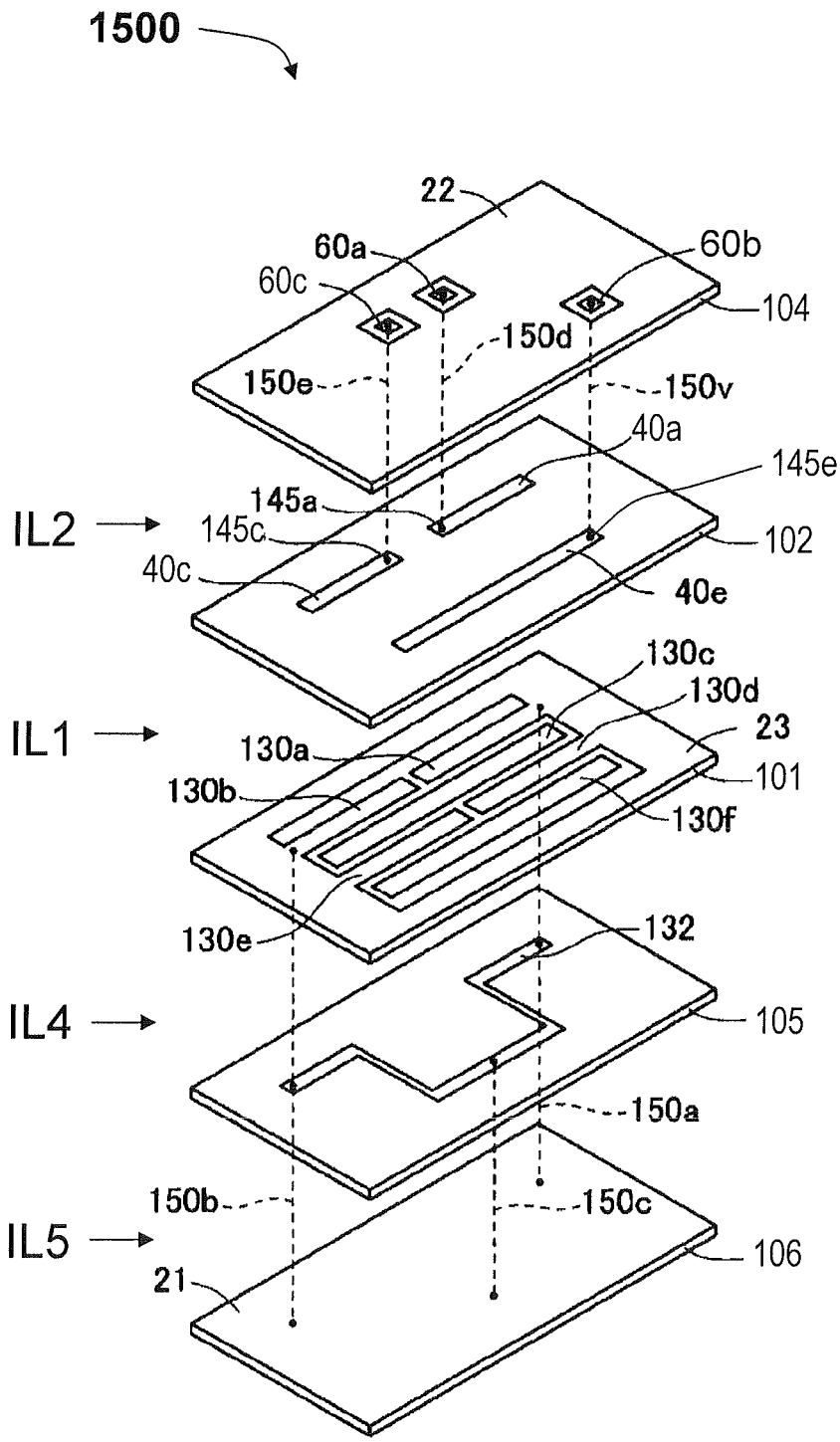
FIG. 15 is an exploded perspective view schematically illustrating the bandpass filter according to one embodiment of the present invention.

FIG. 15 is an exploded perspective view schematically illustrating a bandpass filter 1500 according to an embodiment of the present invention. The main difference between the bandpass filter 1100 and the bandpass filter 1500 is that the second and third coupling electrodes 40*b* and 40*d* of the bandpass filter 1100 is combined to make an output coupling electrode 140*e* of the bandpass filter 1500.

The output coupling electrode 140*e* comprises an output contact point 145*e*. The output contact point 145*e* is connected to the second terminal electrode 60*c*.

In the bandpass filter 1100 illustrated in FIG. 12, the second ½ wavelength resonant electrode 130*f* is electrically connected to the first output contact point 72*b*. In contrast, in the bandpass filter 1500 illustrated in FIG. 15, the second ½ wavelength resonant electrode 130*f* is connected to nothing.

A wireless communication module and a wireless communication device according to one embodiment of the invention may use any one of the bandpass filters mentioned in the above embodiments.

Figure 16:
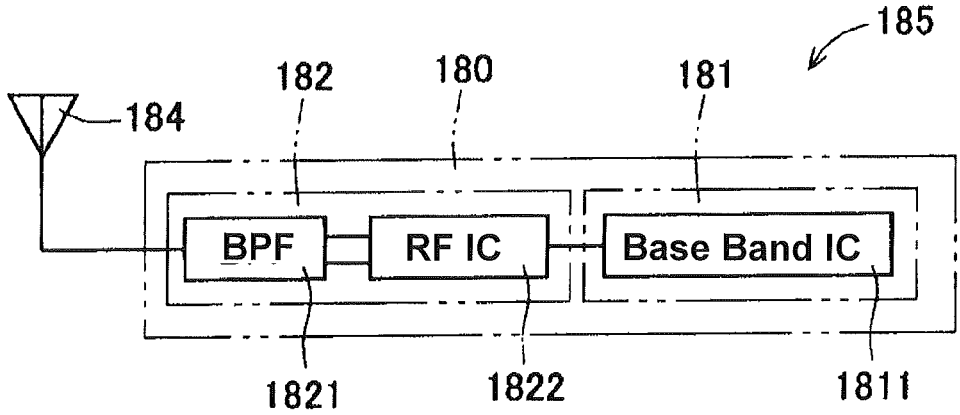
FIG. 16 is a block diagram illustrating a constructional example of a wireless communication device using the bandpass filter according to one embodiment of the present invention.

FIG. 16 is a block diagram illustrating a constructional example of a wireless communication module 180 and a wireless communication device 185 using the wireless communication module 180 according to an embodiment of the present invention, which utilizes a bandpass filter according to the embodiments of the present invention.

The wireless communication module 180 comprises a base band module 181 that performs a processing of a base band signal, and a RF module 182 connected to the base band module 181 and configured to perform a RF signal processing before modulating the base band signal and after reconstructing the signal.

The RF module 182 comprises the bandpass filter 1821. The bandpass filter 1821 can reduce RF signals modulated of the base band signal or received RF signals at a frequency range other than the pass band.

Input signals to the bandpass filter 1821 (base band module 181 side) are differential signals and an output signal to antenna from the bandpass filter 1821 (antenna 184 side) are unbalanced type signals.

Specifically, the base band module comprises a base band IC 1811, and RF module 182 comprises a RF IC 1822 between the pass filter 1821 and base band module 181. It is not needless to say that the wireless communication can comprise another circuit between these modules.

The wireless communication device 85 further comprises an antenna 184 for unbalanced type signals connected to the output of the bandpass filter 1821 of the wireless communication module 180. When passing through the bandpass filter 1821, a transmission signal outputted from the wireless communication device 185 is transmitted through the antenna 84. When passing through the bandpass filter 1821, a receipt signal received through the antenna 84 enters into the wireless communication device 185, with the signals having frequencies other than the communication band attenuated.

The bandpass filter comprises a balanced-to-unbalanced type conversion function. Therefore, the antenna 184 for unbalanced type signals can be directly connected to the RF IC 1822, which output differential signals, with the bandpass filter 1821. That is, a balanced-to-unbalanced type conversion module such as a balanced to unbalanced transformer (balun) is not necessary.

The wireless communication device 85 is not limited to the embodiment showed in FIG. 16. The wireless communication is, for example and without limitation, a cell phone, a wireless card, a router and the like.

In the bandpass filters according to the embodiments of the present invention, the dielectric layers 101 to 107 may comprise a resin such as epoxy resin, or ceramics such as dielectric ceramics. For example, a glass-ceramic material may be appropriately used which comprises a dielectric ceramic material such as $BaTiO_3$, $Pb_4Fe_2Nb_2O_{12}$, $TiO_2$ and a glass material such as $B_2O_3$, $SiO_2$, $Al_2O_3$, ZnO and may be sinterable at a relatively low temperature of about 800° C. to 1200° C. Further, the thickness of the dielectric layers 111 is set, for example, to about 0.05 to 0.4 mm.

A conductive material whose principle constituent is an Ag alloy of, for example, Ag, Ag—Pd, and Ag—Pt or Cu-based, W-based, Mo-based, and Pd-based conductive material is fairly appropriately used for the above-described various electrodes and penetration conductors. The thickness of the various electrodes is set, for example, on the order of 0.001 to 0.03 mm.

The bandpass filters according to the above embodiments may be manufactured, for example, as follows. To begin with, a proper organic solvent is added to ceramic based powder and mixed to form slurry and then form a ceramic green sheet by a doctor blade method. Next, through-holes for penetration conductors, are formed at the obtained ceramic green sheet using a punching machine, and conductive paste such as Ag, Ag—Pd, Au, and Cu, is filled in the through-holes to form penetration conductors. Thereafter, the above described various electrodes are formed on the ceramic green sheet by lithography. Then, these are stacked and pressurized by a hot press device, and fired at a high temperature of 800° C. to 1050° C.

Example 1

Electrical properties of the bandpass filter comprising a structure as shown in FIGS. 6 to 10 were calculated by simulation using a finite element method. The following conditions were used for calculation: relative dielectric constant of the dielectric layers is 9.4; dissipation factor of the dielectric layers is 0.0005; and conductivity of various electrodes is $3.0*10^7$ S/m.

As the shape measurements, the input and output resonant electrodes 30*a*, 30*b* were adapted to have the width of 0.4 mm, the length of 5.8 mm, the central resonant electrodes 30*c*, 30*d* were adapted to have the width of 0.4 mm, the length of 2.9 mm, and the interval of 0.13 mm between two adjacent resonant electrodes.

The input coupling electrodes 40*a*, 40*c* and the output coupling electrodes 40*b*, 40*d* were adapted to have the width of 0.3 mm and the length of 2.5 mm, and the auxiliary input coupling electrodes 41*a*, 41*c* and the auxiliary output coupling electrodes 41*b*, 41*d* were adapted to have the width of 0.3 mm and the length of 1.45 mm.

Each of the auxiliary resonant electrodes 31*a*, 31*b*, 31*c* and 31*d* was adapted to have a first rectangular portion and a second rectangular portion joined to each other; the first rectangular portion is arranged 0.3 mm away from an end of each of the resonant electrodes 30*a* and 30*b*, respectively, and has the width of 0.45 mm and the length of 0.8 mm; and the second rectangular portion is located from the first rectangular portion toward each of the resonant electrodes 30*a* and 30*b* and has the width of 0.2 mm and the length of 0.4 mm.

The third ground electrode was adapted to have a rectangular shape which has the width of 0.4 mm and the length of 0.8 mm. Each of the input terminal electrodes 60*a*, 60*c* and the output terminal electrode 60*b* were adapted to have a square portion whose one edge is 0.3 mm long and to be 0.2 mm away from the second ground electrode 22.

In the external appearance, each of the first ground electrode 21, the second ground electrode 22, and the annular ground electrode 23 was adapted to have the width of 3 mm and the length of 8 mm, and the opening portion of the annular ground electrode 23 was adapted to have the width of 2.4 mm and the length of 6 mm.

The bandpass filter was overall adapted to have the width of 3 mm, the length of 8 mm, and the thickness of 0.91 mm, and to have the dielectric layer 101, on which resonant electrodes 30*a*, 30*b*, 30*c* and 30*d* are located, at the center thereof in the thickness direction. The thickness of the dielectric layer was adapted to be 0.065 mm. The thickness of various electrodes was adapted to be 0.01 mm, and the diameter of various penetration conductors was adapted to be 0.1 mm.

Figure 17:
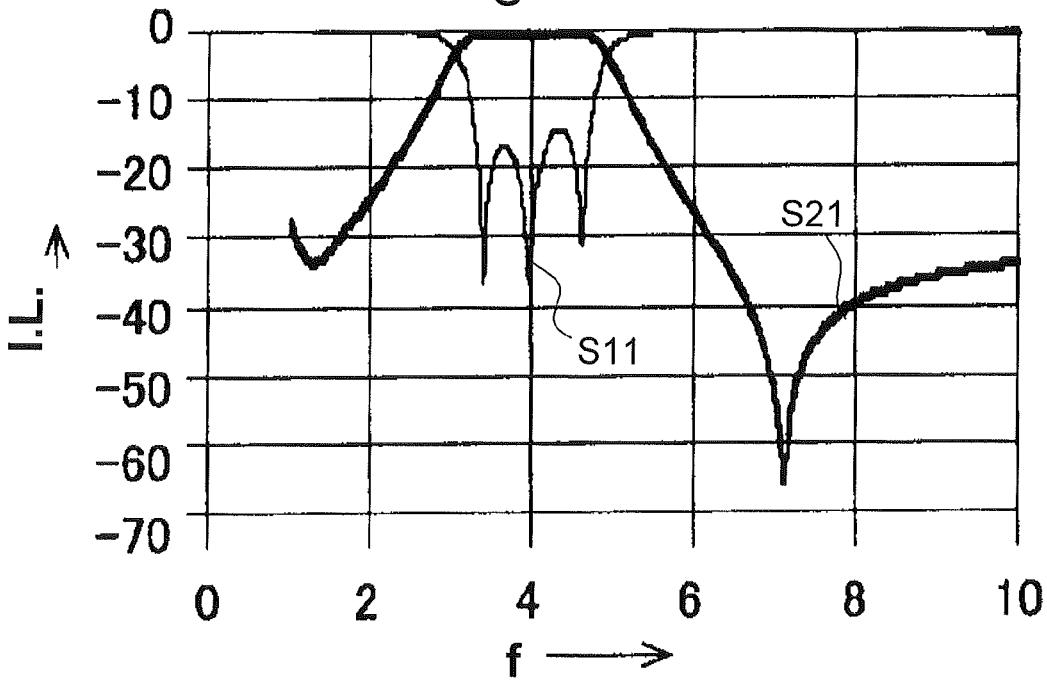
FIG. 17 is a graph showing a result of simulation regarding an electrical characteristic of the bandpass filter shown in FIGS. 6 to 10.

FIG. 17 is a graph illustrating a result of the simulation regarding an electrical characteristic of the bandpass filter, wherein horizontal axis refers to frequencies, vertical axis refers to losses, S21 refers to a transmission characteristic, and S11 refers to a reflection characteristic.

The graph illustrated in FIG. 17 shows the pass characteristics (S21) of the Loss of less than 1.5 dB occurs in the frequency range of 3.2 GHz to 4.7 GHz that corresponds to 40% by the relative bandwidth, which is even broader than the region realized by the conventional filter using the conventional ¼ wavelength resonator. As such, it could be possible to achieve an excellent transmission characteristic of being flat and of low loss over the entire region of the broad pass band and therefore the effectiveness of the present invention might be verified.

Example 2

The transmission properties of the bandpass filter having the structure according to FIG. 14 were calculated by electromagnetic simulation. The following conditions were used for calculation: relative dielectric constant of the dielectric layer 11 is 9.4; dissipation factor is 0.0005; and conductivity is $3.0*10^7$ S/m.

As the shape measurements of the design values used for the trial production, the ¼ resonant electrodes 130*a*, 130*b*, 130*d* and 130*e* were adapted to have the width of 0.4 mm, the length of 2.9 mm. The ½ resonant electrodes 130*c* and 130*f* were adapted to have the width of 0.4 mm, the length of 5.8 mm, and each interval of neighboring resonant electrodes was 0.13 mm.

The coupling electrodes 40*a*, 40*b*, 40*c* and 40*d* were adapted to have the width of 0.3 mm and the length of 2.5 mm, and the auxiliary coupling electrodes 141*a*, 141*b*, 141*c* and 141*d* were adapted to have the width of 0.3 mm and the length of 1.4 mm. Each of the auxiliary resonant electrodes 131*a*, 131*b*, 131*c*, and 131*d* was adapted to have a first rectangular portion and a second rectangular portion joined to each other, wherein the first rectangular portion has the width of 0.55 mm, the length of 0.6 mm, and the second rectangular portion has the width of 0.2 mm and the length of 0.7 mm.

Each of the auxiliary resonant electrodes 131*e*, 131*f*, 131*g* and 131*h* was adapted to have a rectangular shape with the width of 0.65 mm and the length of 0.7 mm.

In the external appearance, each of the first ground electrode 21, the second ground electrode 22, and the annular ground electrode 123 was adapted to have the width of 4.6 mm and the length of 7.1 mm. The opening portion of the annular ground electrode 123 was adapted to have the width of 2.9 mm and the length of 6 mm.

Each of the input terminal electrodes 60*a*, 60*c* and the output terminal electrode 60*b* was adapted to have a square portion whose one edge is 0.3 mm long and to be 0.2 mm away from the second ground electrode 22.

The bandpass filter was overall adapted to have the width of 4.6 mm, the length of 7.1 mm, and the thickness of 0.91 mm, and to have the upper surface of the dielectric layer 101 at the center thereof in the thickness direction. That is, the first inter-layer portion is at the center of the bandpass filter in the thickness direction.

The first portion 132*a* of the resonant electrode coupling conductor 132 has a rectangular shape with the width of 0.2 mm and the length of 1.7 mm. The third portion 132*c* of the resonant electrode coupling conductor 132 has a rectangular shape with the width of 0.2 mm and the length of 3.2 mm. Each of the connection portions 132*d* and 132*f* of the resonant electrode coupling conductor 132 has a rectangular shape with the width of 0.1 mm.

The thickness of each of the dielectric layers 101, 102, 103, 104, 105 and 106 was adapted to be 0.065 mm. That is, the distance between neighboring inter-layer portions is 0.065 mm. The thickness of various electrodes was adapted to be 0.01 mm, and the diameter of various penetration conductors was adapted to be 0.1 mm.

Figure 18:
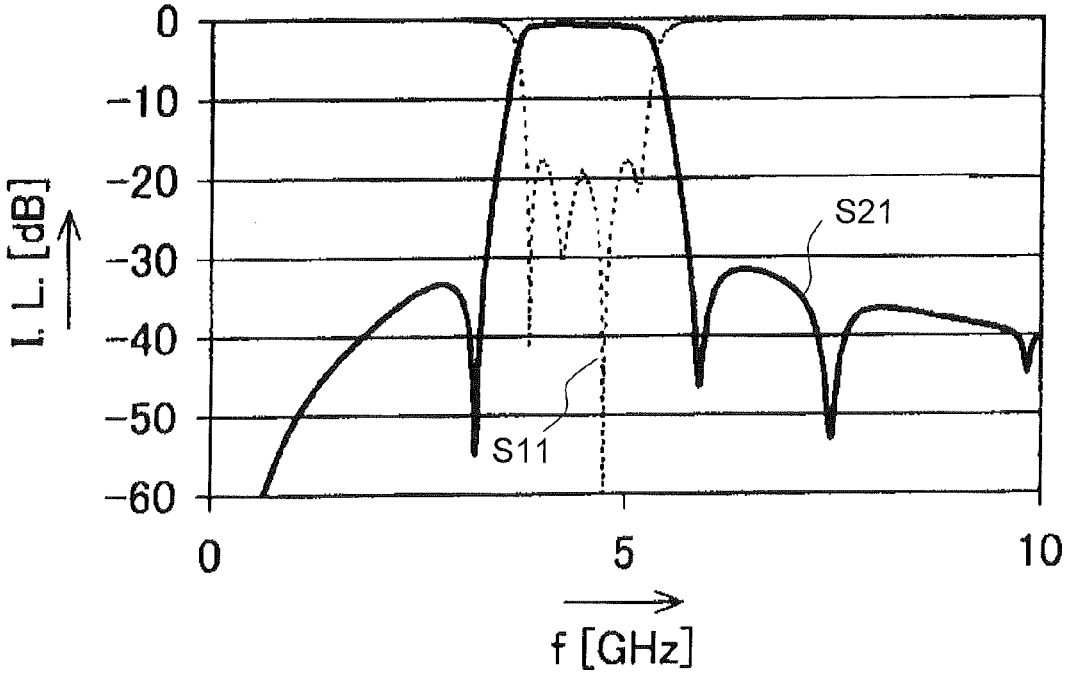
FIG. 18 is a graph showing a result of simulation regarding an electrical characteristic of the bandpass filter shown in FIG. 14.
Figure 19:
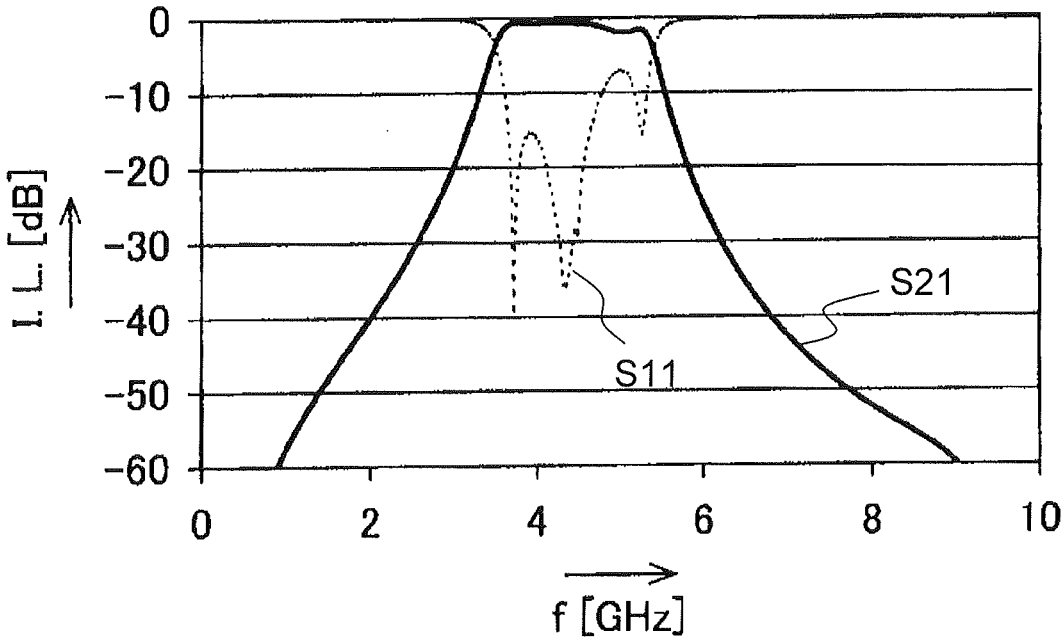
FIG. 19 is a graph showing a result of simulation regarding an electrical characteristic of an existing bandpass filter.

FIG. 18 is a graph illustrating a result of the simulation regarding an electrical characteristic of the bandpass filter shown in FIG. 14. FIG. 19 is a graph showing a result of simulation regarding an electrical characteristic of an existing bandpass filter. In FIGS. 18 and 19, horizontal axis refers to frequencies, vertical axis refers to losses, S21 refers to a transmission characteristic, and S11 refers to a reflection characteristic.

In the meanwhile, the transfer properties of the comparative bandpass filter having the configuration without the resonant electrode coupling conductor 132 shown in FIG. 14 were calculated by electromagnetic simulation. FIG. 19 shows a graph illustrating a result of the simulation regarding the transfer properties of the comparative bandpass filter wherein horizontal axis refers to frequencies, vertical axis refers to losses, S21 refers to a transmission characteristic, and S11 refers to a reflection characteristic.

The graph illustrated in FIG. 18 shows that the band pass filter has a loss in a wide frequency range that corresponds to 40% to 50% by the relative bandwidth than the existing filter having ¼ wavelength resonator.

In addition, compared to the transfer characteristics shown in the graph illustrated in FIG. 19, the bandpass filter shown in FIG. 14 has two attenuation poles obtained at the lower band side and at the higher band side than the pass band near the pass band, and has an abrupt attenuation characteristic near the both cutoff frequencies.

While at least one exemplary embodiment has been presented in the foregoing detailed description, the present disclosure is not limited to the above-described embodiment or embodiments. Variations may be apparent to those skilled in the art. In carrying out the present disclosure, various modifications, combinations, sub-combinations and alterations may occur in regard to the elements of the above-described embodiment insofar as they are within the technical scope of the present disclosure or the equivalents thereof. The exemplary embodiment or exemplary embodiments are examples, and are not intended to limit the scope, applicability, or configuration of the disclosure in any way. Rather, the foregoing detailed description will provide those skilled in the art with a template for implementing the exemplary embodiment or exemplary embodiments. It should be understood that various changes can be made in the function and arrangement of elements without departing from the scope of the disclosure as set forth in the appended claims and the legal equivalents thereof. Furthermore, although embodiments of the present disclosure have been described with reference to the accompanying drawings, it is to be noted that changes and modifications may be apparent to those skilled in the art. Such changes and modifications are to be understood as being included within the scope of the present disclosure as defined by the claims.

Terms and phrases used in this document, and variations hereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent. The term "about" when referring to a numerical value or range is intended to encompass values resulting from experimental error that can occur when taking measurements.

The invention claimed is:

1. A bandpass filter, comprising:

a laminate comprising a plurality of dielectric layers;

a ground electrode on or in the laminate;

a first ½ wavelength resonant electrode in a first inter-layer portion of the laminate, having a strip shape;

a second ½ wavelength resonant electrode in the first inter-layer portion of the laminate, in parallel with the first ½ wavelength resonant electrode, having a strip shape, and operable to output or input an unbalanced signal;

a first ¼ wavelength resonant electrode between a first half portion including a first open end of the first ½ wavelength resonant electrode and a first half portion including a first open end of the second ½ wavelength resonant electrode in the first inter-layer portion, having a strip shape, comprising a ground end and an open end, in parallel to the first half portion of the first ½ wavelength resonant electrode and the first half portion of the second ½ wavelength resonant electrode, sandwiched by the first half portion of the first ½ wavelength resonant electrode and the first half portion of the second ½ wavelength resonant electrode, and operable to electronically couple with the first half portion of the first ½ wavelength resonant electrode and the first half portion of the second ½ wavelength resonant electrode;

a second ¼ wavelength resonant electrode between a second half portion including a second open end of the first ½ wavelength resonant electrode and a second half portion including a second open end of the second ½ wavelength resonant electrode in the first inter-layer portion, having a strip shape, comprising a ground end and an open end, in parallel to the second half portion of the first ½ wavelength resonant electrode and the second half portion of the second ½ wavelength resonant electrode, sandwiched by the second half portion of the first ½ wavelength resonant electrode and the second half portion of the second ½ wavelength resonant electrode, and operable to electromagnetically couple with the second half portion of the first ½ wavelength resonant electrode and the second half portion of the second ½ wavelength resonant electrode;

a first coupling electrode in a second inter-layer portion of the laminate, having a strip shape, facing the first half portion of the first ½ wavelength resonant electrode, comprising a first connection point which faces a half portion of the first half portion of the first ½ wavelength resonant electrode, operable to input or output one half of a differential signal, and operable to electromagnetically couple with the first half portion of the first ½ wavelength resonant electrode;

a second coupling electrode in the second inter-layer portion, having a strip shape, facing the second half portion of the first ½ wavelength resonant electrode, comprising a second connection point which faces a half portion of the second half portion of the first ½ wavelength resonant electrode, operable to input or output the other half of the differential signal, and operable to electromagnetically couple with the second half portion of the first ½ wavelength resonant electrode;

a third coupling electrode in the second inter-layer portion, having a strip shape, facing the first half portion of the second ½ wavelength resonant electrode, and operable to electromagnetically couple with the first half portion of the second ½ wavelength resonant electrode;

a fourth coupling electrode in the second inter-layer portion, having a strip shape, facing the second half portion of the second ½ wavelength resonant electrode, and operable to electromagnetically couple with the second half portion of the second ½ wavelength resonant electrode.

2. A wireless communication module, comprising:

an RF module comprising a bandpass filter according to claim 1; and a base band module connected to the RF module.

3. A wireless communication device, comprising:

an RF module comprising a bandpass filter according to claim 1;

a base band module connected to the RF module; and an antenna connected to the bandpass filter.

4. The bandpass filter according to claim 1, wherein the first ¼ wavelength resonant electrode is adjacent to both of the first half portion of the first ½ wavelength resonant electrode and the first half portion of the second ½ wavelength resonant electrode, wherein the second ¼ wavelength resonant electrode is adjacent to both of the second half portion of the first ½ wavelength resonant electrode and the second half portion of the second ½ wavelength resonant electrode.

5. A bandpass filter, comprising:

a laminate comprising a plurality of dielectric layers;

a ground electrode on or in the laminate;

a first ½ wavelength resonant electrode in a first inter-layer portion of the laminate, having a strip shape;

a second ½ wavelength resonant electrode in the first inter-layer portion of the laminate, in parallel with the first ½ wavelength resonant electrode, having a strip shape, and operable to output or input an unbalanced signal;

a first ¼ wavelength resonant electrode between a first half portion including a first open end of the first ½ wavelength resonant electrode and a first half portion including a first open end of the second ½ wavelength resonant electrode in the first inter-layer portion, having a strip shape, comprising a ground end and an open end, in parallel to the first half portion of the first ½ wavelength resonant electrode and the first half portion of the second ½ wavelength resonant electrode, and sandwiched by the first half portion of the first ½ wavelength resonant electrode and the first half portion of the second ½ wavelength resonant electrode;

a second ¼ wavelength resonant electrode between a second half portion including a second open end of the first ½ wavelength resonant electrode and a second half portion including a second open end of the second ½ wavelength resonant electrode in the first inter-layer portion, having a strip shape, comprising a ground end and an open end, in parallel to the second half portion of the first ½ wavelength resonant electrode and the second half portion of the second ½ wavelength resonant electrode, and sandwiched by the second half portion of the first ½ wavelength resonant electrode and the second half portion of the second ½ wavelength resonant electrode;

a first coupling electrode in a second inter-layer portion of the laminate, having a strip shape, facing the first half portion of the first ½ wavelength resonant electrode, comprising a first connection point which faces a half portion of the first half portion of the first ½ wavelength resonant electrode, operable to input or output one half of a differential signal;

a second coupling electrode in the second inter-layer portion, having a strip shape, facing the second half portion of the first ½ wavelength resonant electrode, comprising a second connection point which faces a half portion of the second half portion of the first ½ wavelength resonant electrode, operable to input or output the other half of the differential signal;

a third coupling electrode in the second inter-layer portion, having a strip shape, facing the first half portion of the second ½ wavelength resonant electrode;

a fourth coupling electrode in the second inter-layer portion, having a strip shape, facing the second half portion of the second ½ wavelength resonant electrode;

an annular ground electrode on the first inter-layer portion, surrounding the first ½ wavelength resonant electrode, the second ½ wavelength resonant electrode, the first ¼ wavelength resonant electrode and the second ¼ wavelength resonant electrode, and connected to the ground end of the first ¼ wavelength resonant electrode and the ground end of the second ¼ wavelength resonant electrode;

a first auxiliary resonant electrode electrically connected to the first ½ wavelength resonant electrode at an area near the first open end of the first ½ wavelength resonant electrode, and facing a part of the annular ground electrode;

a second auxiliary resonant electrode electrically connected to the second ½ wavelength resonant electrode at an area near the first open end of the second ½ wavelength resonant electrode, and facing a part of the annular ground electrode; and a second ground electrode facing the open end of the first ¼ wavelength resonant electrode.

6. The bandpass filter according to claim 5, wherein the second ground electrode further faces the open end of the second ¼ wavelength resonant electrode;

and further comprising:

a third auxiliary resonant electrode electrically connected to the first ½ wavelength resonant electrode at an area near the second open end of the first ½ wavelength resonant electrode, and facing a part of the annular ground electrode; and a fourth auxiliary resonant electrode electrically connected to the second ½ wavelength resonant electrode at an area near the second open end of the second ½ wavelength resonant electrode, and facing a part of the annular ground electrode.

7. The bandpass filter according to claim 6, further comprising:

a first auxiliary coupling electrode in a third inter-layer portion of the laminate, facing a part of the first auxiliary resonant electrode, electrically connected to the first coupling electrode and operable to input or output said one half of the differential signal;

a third auxiliary coupling electrode in the third inter-layer portion of the laminate, facing a part of the third auxiliary resonant electrode, electrically connected to the second coupling electrode and operable to input or output the other half of the differential signal;

a second auxiliary coupling electrode in the third inter-layer portion of the laminate, facing a part of the second auxiliary resonant electrode; and a fourth auxiliary coupling electrode in the fourth inter-layer portion of the laminate, facing a part of the fourth auxiliary resonant electrode.

* * * * *